US005697021A

United States Patent [19]

Watanabe et al.

[11] Patent Number: 5,697,021

[45] Date of Patent: Dec. 9, 1997

[54] SEALING MEMBER FEATURING A COMPRESSABLE SEAL PORTION, AND PROCESS CARTRIDGE AND IMAGE FORMING APPARATUS USING SAME

[75] Inventors: Kazushi Watanabe, Yokohama; Yoshikazu Sasago, Tokyo; Shinya Noda, Yokohama; Kazumi Sekine, Kawasaki, all of Japan

[73] Assignee: Canon Kabushiki Kaisha, Tokyo, Japan

[21] Appl. No.: 531,905

[22] Filed: Sep. 21, 1995

Related U.S. Application Data

[62] Division of Ser. No. 224,720, Apr. 8, 1994, Pat. No. 5,475,467.

[30] Foreign Application Priority Data

| | | | |
|---|---|---|---|
| Apr. 7, 1993 | [JP] | Japan | 5-114162 |
| Apr. 19, 1993 | [JP] | Japan | 5-114163 |
| May 19, 1993 | [JP] | Japan | 5-139242 |

[51] Int. Cl.[6] ..... G03G 21/18

[52] U.S. Cl. ..... 399/102; 399/111

[58] Field of Search ..... 355/200, 210, 355/211, 215, 260, 296; 399/102, 103, 111

[56] References Cited

U.S. PATENT DOCUMENTS

| | | | |
|---|---|---|---|
| 3,985,436 | 10/1976 | Tanaka et al. | 355/200 |
| 4,500,195 | 2/1985 | Hosono | 355/208 |
| 4,540,268 | 9/1985 | Toyono et al. | 355/210 |
| 4,627,701 | 12/1986 | Onoda et al. | 355/221 |
| 5,029,316 | 7/1991 | Koiso | 355/299 |
| 5,057,868 | 10/1991 | Sekino et al. | 355/215 |
| 5,134,960 | 8/1992 | Shirai | 355/215 X |
| 5,166,733 | 11/1992 | Eliason | 355/215 X |
| 5,212,521 | 5/1993 | Ogawa et al. | 355/215 |
| 5,294,960 | 3/1994 | Nomura et al. | 355/210 |
| 5,485,249 | 1/1996 | Higeta et al. | 355/215 X |
| 5,502,547 | 3/1996 | Shirai | 355/215 |

FOREIGN PATENT DOCUMENTS

| | | | |
|---|---|---|---|
| 4-174885 | 6/1992 | Japan | 355/296 |
| 4-181280 | 6/1992 | Japan | 355/296 |

*Primary Examiner*—William J. Royer

*Attorney, Agent, or Firm*—Fitzpatrick, Cella, Harper & Scinto

[57] ABSTRACT

A process cartridge detachably mountable to an image forming apparatus includes a frame member, a photosensitive member, a rotary member mounted on the frame member, where the rotary member constitutes a process device. A blade member is mounted on the frame member in proximity with the rotary member. A sealing member has a rotary seal portion for sealing a space formed between the frame member and the rotary member. A blade seal portion seals a space formed between the frame member and the blade member. A compressible seal portion, provided in a portion of the rotary seal portion and the blade seal portion, seals a space formed adjacent to a longitudinal end portion of the blade member.

29 Claims, 27 Drawing Sheets

A-A

B - B

SEALING MEMBER FEATURING A COMPRESSABLE SEAL PORTION, AND PROCESS CARTRIDGE AND IMAGE FORMING APPARATUS USING SAME

This application is a division of application Ser. No. 08/224,720 filed Apr. 8, 1994, now U.S. Pat. No. 5,475,467.

BACKGROUND OF THE INVENTION

1. Field of the Invention

The present invention relates to a sealing member for sealing toner within a processing means used for forming an image with the toner, a process cartridge employing such a sealing member, and an image forming apparatus into which the process cartridge can be loaded.

2. Description of the Related Art

An image forming apparatus, such as a printer, performs selective exposures onto a uniformly charged image carrier to form a latent image. The latent image is made visible by toner, and the toner image is transferred to a recording medium so that the image may be recorded. In such an apparatus, additional toner must be supplied each time it is used up. Not only is this operation for supplying toner inconvenient, but the operator's hands may become dirty. Also, it is necessary to periodically perform maintenance of each member of the apparatus.

FIG. 32 illustrates a conventional process cartridge in which supplying of toner and replacement of parts of an image carrier whose service life is finished are made possible when a user loads the cartridge into the main body of the apparatus. Maintenance is made easier since an image carrier 50, a charger 51, a developing unit 52, a cleaning unit 53 and the like are formed integrally into the cartridge (see, for example, U.S. Pat. Nos. 3,985,436, 4,500,195, 4,540,268 and 4,627,701).

In such a process cartridge, the developing unit 52 is provided with a sealing member 55 so that toner will not leak out from a gap formed between a development sleeve **52*a* and a development frame member 54. The cleaning unit 53 has a sealing member 56 provided in the end portion of the image carrier 50 so that waste toner will not leak out from the gap formed between the end portion of the image carrier 50 and a waste toner well 53*a***.

One type of the above-mentioned sealing member is formed of foam rubber, felt or the like so that it can be applied onto a container. Another type is formed of a material such as plastic, has a lip portion which slidably contacts process means such as the development sleeve **52*a***, the frame member or the like so that the other type can be installed into the frame member.

However, in the former sealing member, it is time-consuming to apply the sealing member, and automation of attachment is difficult. The latter sealing member has the advantage that attachment is easy. However, the dimensions of the portion where the sealing member comes into close contact with the frame member varies, causing a problem, for example, of the toner leaking from the gap.

SUMMARY OF THE INVENTION

It is an object of the present invention to provide a sealing member, which is easy to mount, and a process cartridge and an image forming apparatus using such a sealing member.

It is another object of the present invention to provide a sealing member which provided a secure seal, and a process cartridge and an image forming apparatus for using such a sealing member.

It is a further object of the present invention to provide a sealing member which can be easily attached to a cartridge having a blade member which elastically abuts against process means and which provide a secure seal between the blade and the frame member.

It is yet another object of the present invention to provide a sealing member which makes an attachment operation easier.

In one aspect, the present invention relates to a sealing member for an image forming apparatus, such as a developer cartridge, a facsimile device, an electrophotographic copier, or the like, such apparatus including a frame member, a blade member and a rotary member. The sealing member includes a first lip portion for abutting the frame member, a second lip portion for abutting a longitudinal end portion of the blade member, and a third lip portion for abutting the rotary member.

In another aspect, the present invention relates to a process cartridge detachably mountable to an image forming apparatus. The cartridge includes a frame member, a rotary member mounted on the frame member, a blade member abutting the rotary member, and a sealing member. The sealing member includes a first lip portion for abutting the frame member, a second lip portion for abutting a longitudinal end portion of the blade member, and a third lip portion for abutting the rotary member.

In another aspect, the present invention relates to an image forming member to which the above process cartridge is detachably mountable. The image forming apparatus comprising cartridge mounting means, optical means for projecting light according to image information, and feeding means for feeding a recording medium.

In another aspect, the present invention relates to an image forming apparatus comprising a detachably mountable cartridge. The apparatus includes cartridge mounting means including a frame member, a rotary member (process means) mounted on the frame member, a blade member abutting the rotary member, and a process cartridge. The process cartridge includes a first lip portion for abutting the frame member, a second lip portion for abutting a longitudinal end of the blade member, and a third lip portion for abutting the rotary member.

In another aspect, the present invention relates to a detachably mountable process cartridge including a frame member, an image carrier (e.g., a photoelectric drum), developing means, cleaning means (e.g., a cleaning blade) and a sealing member. The sealing member has an image carrier seal portion for preventing toner from leaking from a space formed between the image carrier and the frame member, a developing seal portion for preventing toner from leaking from a space formed between the development means and the frame member, and a cleaning seal portion for preventing toner from leaking from a space formed between the cleaning means and the frame member.

In another aspect, the present invention relates to a detachably mountable process cartridge comprising a frame member, process means (e.g., an image carrier, developer roller, cleaning blade, or the like), and a sealing member for preventing toner from leaking from a space formed between the frame member and the process means. The sealing member includes engaging means (e.g., hooks, tabs, or the like) for engaging the sealing member with the frame member.

In another aspect, the present invention relates to a sealing member for an image forming apparatus including a frame member and process means forming a gap therebetween, said sealing member being securely disposable in the gap and composed of soft plastic and a magnetic substance.

In another aspect, the present invention relates to a sealing member for an image forming apparatus including a frame member, a rotary member, and a blade member. The sealing member includes a rotary seal portion for sealing a space formed between the frame member and the rotary member, a blade seal portion for sealing a space formed between the frame member and the blade member, and a compressable seal portion provided in a portion of the rotary seal portion and the blade seal portion, for sealing a space formed adjacent a longitudinal end portion of the blade member.

The above and further objects, aspects and novel features of the invention will more fully appear from the following detailed description when the same is read in connection with the accompanying drawings. It is to be expressly understood, however, that the drawings are for the purpose of illustration only and are not intended to limit the definition of the invention.

BRIEF DESCRIPTION OF THE DRAWINGS

FIG. 16(*b*) is a sectional view taken along line B—B of FIG. 15;

DETAILED DESCRIPTION OF THE PREFERRED EMBODIMENTS

[First Embodiment]

A sealing member, a process cartridge employing the sealing member, and an image forming apparatus in accordance with the first embodiment of the present invention will be explained below in detail with reference to the accompanying drawings.

Figure 1:
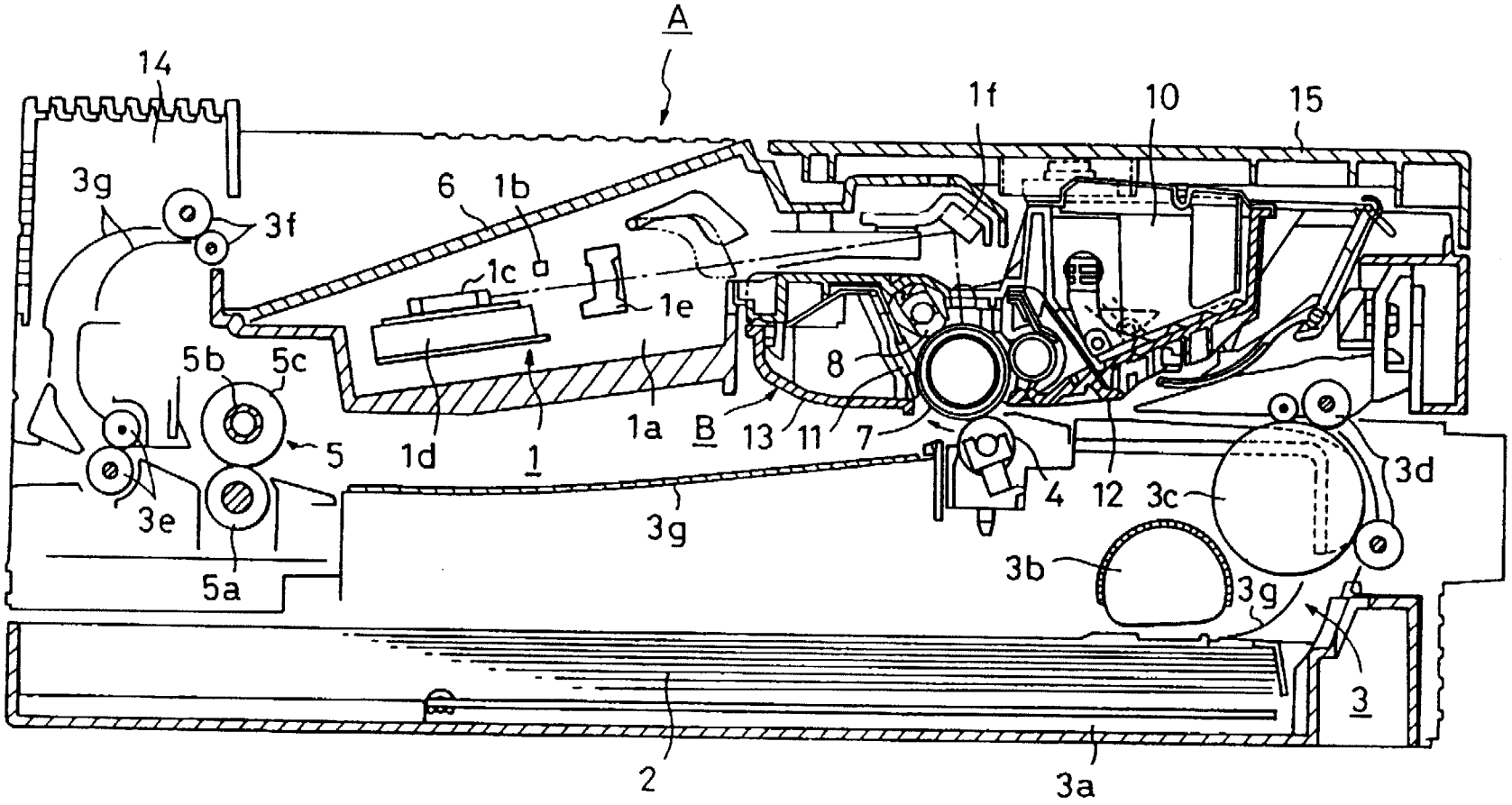
FIG. 1 is a sectional view of an image forming apparatus according to a first embodiment of the present invention.
Figure 2:
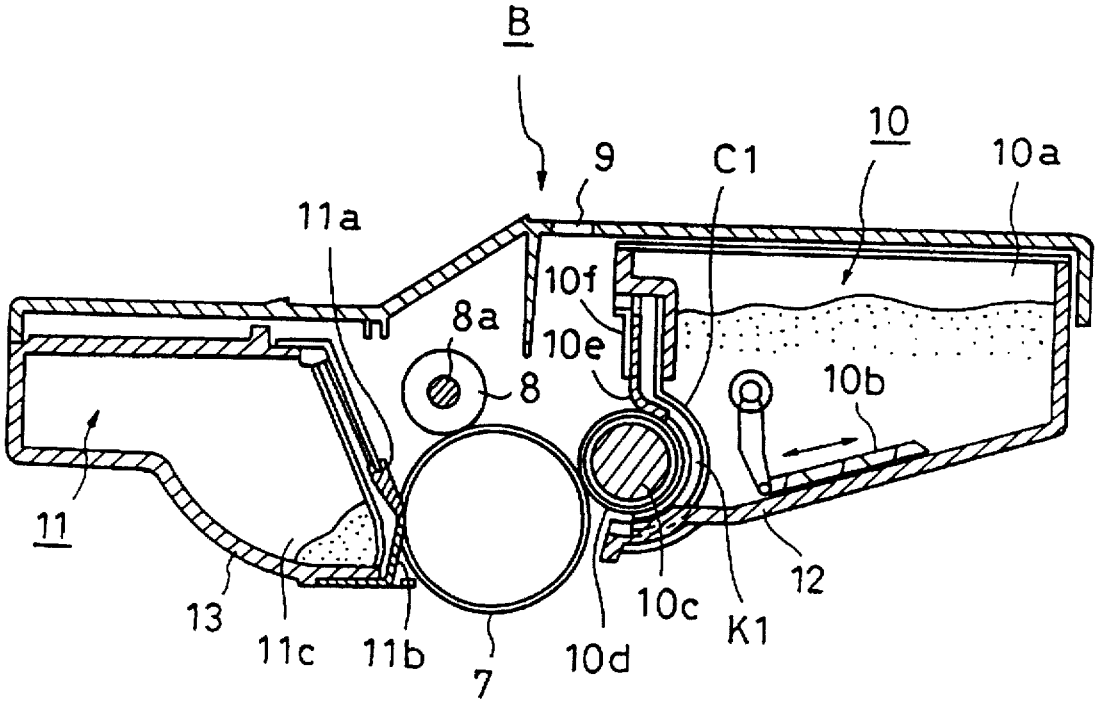
FIG. 2 is a sectional view of the process cartridge which is loaded into the image forming apparatus.

The entire schematic construction of the image forming apparatus having a process cartridge installed therein will be explained first. FIG. 1 is a sectional view of an embodiment of an image forming apparatus of the present invention including a laser printer. FIG. 2 is a sectional view of a process cartridge of the apparatus of FIG. 1.

As shown in FIG. 1, the image forming apparatus A projects a light image based on image information from an optical means 1 so that a developing agent (hereinafter referred to as toner) image is formed on a photosensitive drum 7 which is an image carrier. Then, a recording medium 2 is fed by feeding means 3 in synchronization with the formation of a toner image, and the toner image formed on the photosensitive drum 7 in the image forming section, which is integrally formed in a process cartridge B, is transferred to the recording medium 2 by transfer means 4. The recording medium 2 then is transferred to fixing means 5 where the transferred toner image is fixed and then ejected onto an ejection tray 6.

As shown in FIG. 2, the process cartridge B, which constitutes the image forming section, makes a photosensitive drum 7 rotate to uniformly charge the surface thereof by charging means 8, and exposes a light image from the optical means onto the photosensitive drum 7 via an exposure section 9, to form a latent image on the photosensitive drum 7. A toner image corresponding to the latent image is formed by developing means 10, thus making the image visible. After the toner image is transferred to the recording medium 2 by the transfer means 4, toner remaining on the photosensitive drum 7 is removed by cleaning means 11. These elements, including the photosensitive drum 7, are housed inside a toner development frame member 12 and a cleaning frame member 13, which together constitute a housing, so that they are formed into a cartridge. Each part of the process cartridge B is provided with a sealing member C1 for preventing the toner from leaking.

Next, a description will be given of the construction of each part of the image forming apparatus A and the process cartridge B, and further the construction of the sealing member C1.

{Image forming apparatus}

The construction of each part of the image forming apparatus A will be explained first in the following order: optical means, feeding means, transfer means, fixing means, and cartridge mounting means.

(Optical means)

The optical means 1 projects a light image onto the photosensitive drum 7 by projecting light on the basis of image information read from an external apparatus or the like. As shown in FIG. 1, a laser diode 1*b*, a polygon mirror 1*c*, a scanner motor 1*d*, and an image forming lens 1*e* are housed inside an optical unit 1*a* of the main body 14 of the apparatus.

When, for example, an image signal is supplied from an external apparatus such as a computer or a word processor, the laser diode 1*b* emits light in response to the image signal, and projects the light onto the polygon mirror 1*c* as image light. Polygon mirror 1*c* is rotated at high speed by the scanner motor 1*d*. The image light reflected by the polygon mirror 1*c* is projected onto the photosensitive drum 7 via the image forming lens 1*e* and a reflecting mirror 1*f*. The surface of the photosensitive drum 7 is thus selectively exposed to form a latent image corresponding to the image information.

(Recording medium feeding means)

Next, the construction of the feeding means 3 for feeding the recording medium 2 (e.g., a recording paper, OHP sheet, cloth, or thin plate) will be explained. A loading portion of a cassette 3*a* is provided in the inner bottom portion of the main body 14 of the apparatus. When an image formation start signal is input, the recording media 2 within the cassette 3*a* are fed one by one from the top of the stack by a pickup roller 3*b*, a feeding roller 3*c* and follower rollers 3*d* pressed against the feeding roller 3*c*.

The recording medium 2 is fed to the nip portion between the photosensitive drum 7 and the transfer means 4 in synchronization with the performing of the image formation operation. The recording medium 2 onto which a developed image has been transferred is fed to the fixing means 5 and then ejected onto the ejection tray 6 by a pair of intermediate ejection rollers 3*e* and a pair of ejection rollers 3*f*. A pair of guide members 3*g* for guiding the feeding of the recording medium 2 is provided between each of the above-mentioned pairs of rollers.

(Transfer means)

The transfer means 4 transfers the developed latent image or toner image formed on the photosensitive drum 7 in the image forming section onto the recording medium 2. The transfer means 4 in this embodiment is formed of the transfer roller 4 as shown in FIG. 1. That is, the recording medium 2 is pressed by the transfer roller 4 against the photosensitive drum 7 of the loaded process cartridge B. A voltage having a polarity opposite that of the latent image formed on the photosensitive drum 7 is applied to transfer roller 4, so that the toner on the photosensitive drum 7 is transferred to the recording medium 2.

(Fixing means)

The fixing means 5 fixes the toner image transferred to the recording medium 2 by applying a voltage to the transfer means 4. As shown in FIG. 1, the fixing means 5 comprises a driving rotating roller 5*a* and a fixing roller 5*c* having a heater 5*b* therein and rotating in a driven manner in pressed contact with the drive roller 5*a*. More specifically, when the recording medium 2 to which the toner image has been drive roller 5*a* and the fixing roller 5*c*, a pressure is applied by the pressing forces of the drive roller 5*a* and the fixing roller 5*c*, and heat is applied to the recording medium 2 by heat generated in the fixing roller 5*c*, thereby causing the toner on the recording medium 2 to be fixed to the recording medium 2.

(Process cartridge loading means)

A process cartridge loading means by which the process cartridge B is loaded is disposed within the image forming apparatus A. Loading and unloading of the process cartridge B to and from the main body 14 of the apparatus is performed by opening an open/close cover 15. Open/close cover 15 may be provided with a conventional hinge (not shown) so that it can be opened/closed, and is mounted in the upper portion of the main body 14 of the apparatus. Opening the open/close cover 15 reveals a cartridge loading space provided inside the main body 14 of the apparatus, including conventional left and right guide members (not shown) mounted on the left and right inner wall surfaces of the main body. Each of these guide members is provided with a guide for inserting the process cartridge B. The process cartridge B is inserted into and along the guides, and by closing the open/close cover 15, the process cartridge B is loaded into the image forming apparatus A.

{Process cartridge}

Next, a description will be given of the construction of each part of the process cartridge B which is loaded into the image forming apparatus A.

This process cartridge B comprises an image carrier and at least one process means. The process means includes charging means for charging the surface of the image carrier, developing means for forming a toner image on the image carrier, cleaning means for cleaning the toner remaining on the surface of the image carrier and the like. In the process cartridge B of this embodiment, as shown in FIG. 2, the charging means 8, the exposure section 9, the developing means 10, and the cleaning means 11 are arranged around a photosensitive drum 7, which is an image carrier. These elements are covered with a frame member formed of the toner development frame member 12 and the cleaning frame member 13 so that they are formed into one unit, thus making it possible to load and unload the unit into and out of the main body 14 of the apparatus.

Next, a description will be given of the construction of each part of the process cartridge B in the following order: the photosensitive drum 7, the charging means 8, the exposure section 9, the developing means 10 and the cleaning means 11.

(Photosensitive drum)

The photosensitive drum 7 of this embodiment has an organic photosensitive layer coated onto the outer peripheral surface of a cylindrical drum base formed of aluminum. The photosensitive drum 7 is rotatably mounted on a frame member of the cartridge, and the driving force of a drive motor disposed in the main body 14 of the apparatus is transmitted to a gear (not shown) fixedly mounted on one of the longitudinal ends of the photosensitive drum 7. As a result, the photosensitive drum 7 is caused to rotate in the direction of the arrow in FIG. 1 in accordance with the performing of an image forming operation.

(Charging means)

The charging means 8 is used to uniformly charge the surface of the photosensitive drum 7. In this embodiment, a so-called contact charging method in which the charging means 8 is rotatably mounted on frame member 12 is used. An electroconductive elastic layer is provided on a metallic roller shaft 8*a* of the charging means 8, a high-resistance elastic layer is provided on the electroconductive elastic layer, and further a protective film is provided on the surface of the resistance elastic layer. The electroconductive elastic layer is formed in such a way that carbon is dispersed in an elastic rubber layer of EPDM, NBR or the like. This layer guides a bias voltage supplied to the roller shaft 8*a*. The high-resistance elastic layer is made of urethane rubber or the like, and contains, for example, a small amount of electroconductive fine powder. When a highly electroconductive charging roller is used as the photosensitive drum 7, if any surface incontinuities, such as pin holes, face each other, they limit an electric current which leaks to the photosensitive drum 7 to prevent a sharp drop of the bias voltage. The protective layer, made of N-methylmethoxy nylon, works to prevent a plastic material of either the electroconductive elastic layer or the high-resistance elastic layer from contacting the photosensitive drum 7 so that the surface of the photosensitive drum 7 is not deteriorated.

The charging roller 8 is brought into contact with the photosensitive drum 7, so that the charging roller 8 is rotated in a driven relation with the rotation of the photosensitive drum 7 during the image formation. A DC voltage and an AC voltage are superposed and applied to the charging roller 8, and the surface of the photosensitive drum 7 is uniformly charged.

(Exposure section)

An exposure section exposes a light image projected from the optical means onto the surface of the photosensitive drum 7 uniformly charged by the charging roller 8 so that a latent image is formed on the surface of the photosensitive drum 7. An opening 9 for guiding the light image onto the top surface of the cartridge frame member 12 is provided to form the exposure section.

(Developing means)

As shown in FIG. 2, the developing means 10 has a toner well 10*a* for housing toner, and a reciprocating toner feeding member 10*b*. Toner feeding member 10*b* is provided within toner well 10*a* and reciprocates in a direction of the double head arrow shown in FIG. 2, to circulate toner within toner well 10*a*. A development sleeve 10*d* has a magnet 10*c* therein, which forms a thin toner layer on the surface thereof as a result of its rotation, and is disposed in spaced relation from the photosensitive drum 7 with a very small distance therebetween.

When a toner layer is formed on the surface of the development sleeve 10*d*, a friction-charged electric charge sufficient to develop the latent image on the photosensitive drum 7 is obtained by the friction generated between the toner and the development sleeve 10*d*. A development blade 10*e* is disposed adjacent photosensitive drum 7 to regulate the thickness of the toner layer formed therebetween.

(Cleaning means)

As shown in FIG. 2, the cleaning means 11 comprises a cleaning blade 11*a*, positioned in contact with the surface of photosensitive drum 7, for scraping off the toner remaining on the photosensitive drum 7, a skimming sheet 11*b*, positioned below the cleaning blade 11*a* arranged in weak contact with the surface of the photosensitive drum 7, for skimming up the toner which has been scraped off, and a waste toner well 11*c* for storing the scraped off waste toner.

{Sealing member}

Figure 3:
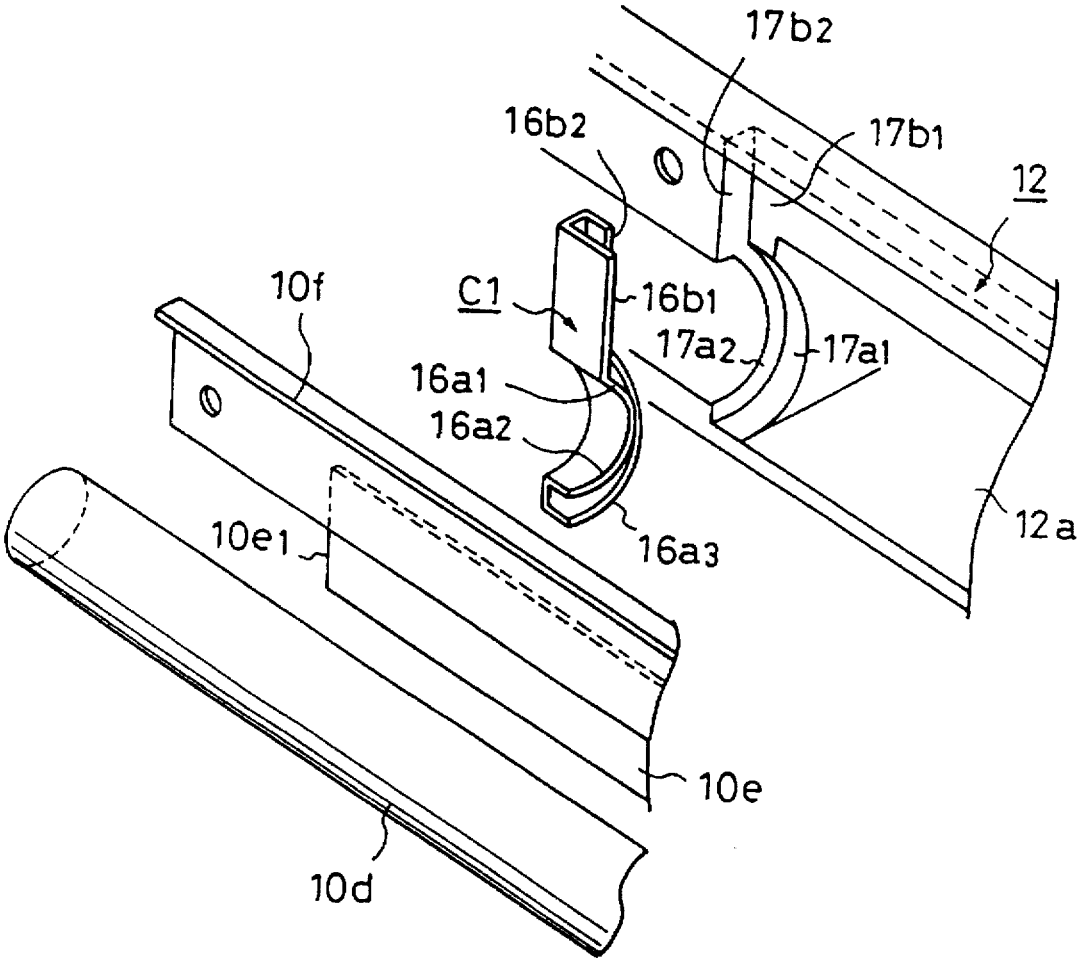
FIG. 3 is an illustration of the mounting configuration for the sealing member.

The axial end portions (only one end portion is shown in FIG. 2) of the development sleeve 10*d* of the developing means 10 in the process cartridge B are provided on the frame member 12, with a gap K1 being formed between the development sleeve 10*d* and each of the following elements: a development blade 10*e*, a blade support member 10*f*, and the development frame member 12. Therefore, a sealing member C1 shown in FIG. 3 is provided in gap K1, thus preventing the toner leakage. Next, the sealing member C1 will be explained.

Figure 4A:
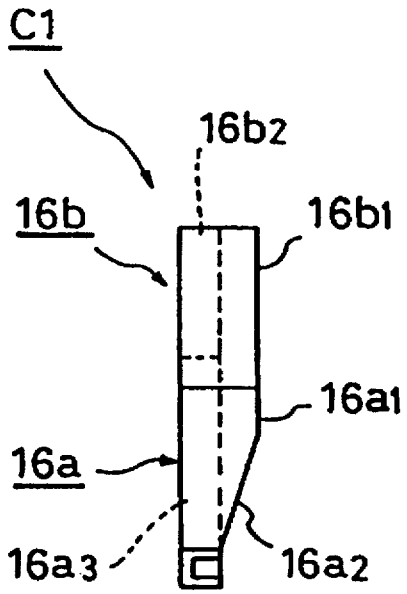
FIGS. 4(*a*) and 4(*b*) are illustrations of the construction of the sealing member.
Figure 4B:
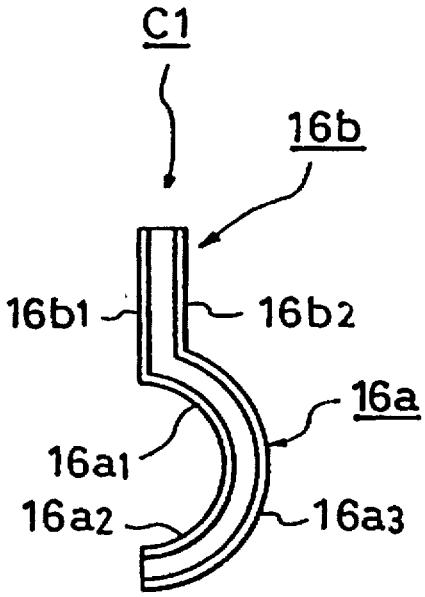

The sealing member C1 is composed of a soft plastic (e.g., POM, PP, PE, nylon, or tetrafluoroethylene), and as shown in FIGS. 3, 4(*a*) and 4(*b*) formed of a semi-circular portion 16*a*, which is arranged in abutment with the development sleeve 10*d* and the development blade 10*e*, and a straight portion 16*b*, which is linked with the semi-circular portion 16*a*. An opening 12*a* for guiding the toner in the toner well 10*a* to the development sleeve 10*d* is provided in the frame member 12 in which the sealing member C1 is mounted. Step portions formed of semi-circular seating surfaces 17*a*1 and 17*a*2 and straight-line seating surfaces 17*b*1 and 17*b*2 are formed in the end portions (only one of the longitudinal end portions is shown in FIG. 3) of the frame member 12, the sealing member C1 being engaged with the step portions.

Lip portions 16*a*1, 16*a*2 and 16*a*3 are formed in the semi-circular portion 16*a* of the sealing member C1, and lip portions 16*b*1 and 16*b*2 are formed in the straight-line portion 16*b*, so that the sectional surface of the sealing member C1 is shaped in the form of a sideways "U". The lip portion 16*a*1 is mounted so as to be brought into abutment with the longitudinal end portion 10*e*1 of the development blade 10*e* and the development sleeve 10*d*, the lip portion 16*a*2 is mounted so as to be brought into abutment with the development sleeve 10*d*, and the lip portion 16*a*3 is mounted so as to be brought into abutment with the seating surface 17*a*1. The lip portion 16*b*1 provided in the straight-line portion 16*b* is mounted so as to be brought into abutment with the longitudinal end portion 10*e*1 of the development blade 10*e* and the blade support member 10*f*, and the lip portion 16*b*2 is mounted so as to be brought into abutment with the seating surface 17*b*1.

That is, the sealing member C1 has the first lip portions 16*a*3 and 16*b*2 which are in abutment with the seating surfaces 17*a*1 and 17*b*1 of the frame member 12, the second lip portion 16*a*1 which is in abutment with the longitudinal end portion 10*e*1 of the development blade 10*e*, the third lip portion 16*a*2 which is in abutment with the development sleeve 10*d* which is a rotary member, and the fourth lip portion 16*b*1 which is in abutment with the longitudinal end portion 10*e*1 of the development blade 10*e* and the blade support member 10*f*.

As a result of the sealing member C1 provided with the lip portions 16*a*1 and 16*b*1 which are in abutment with the longitudinal end portion 10e1 of the development blade 10e, being engaged with the seating surface of the frame member 12, leakage of toner from the longitudinal end portion 10e1 of the development blade 10e can be prevented without using a seal such as foam rubber. Since it is only necessary to assemble the sealing member C1, which is just one part, to the seating surface provided in the frame member 12, the attachment can be performed very easily.

[Second embodiment]

Figure 5A:
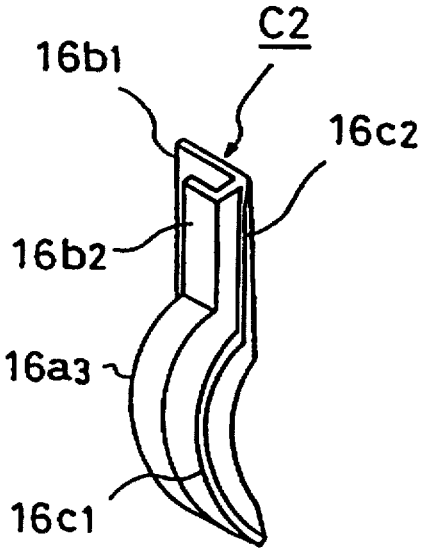
FIGS. 5(*a*) and 5(*b*) are illustrations of a sealing member in accordance with a second embodiment of the present invention.
Figure 5B:
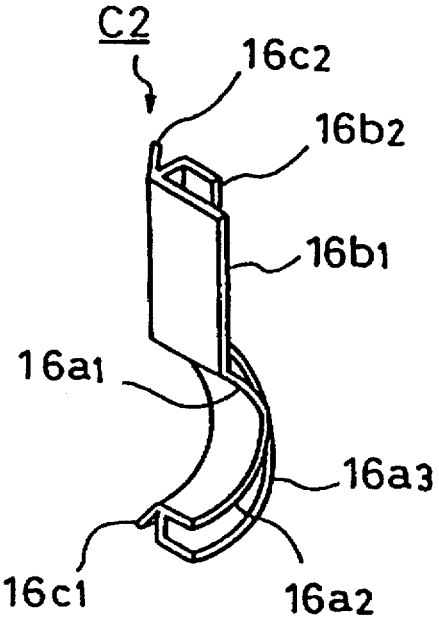

If, in the above-described first embodiment, a gap is created between the lip portions 16a1 and 16b1 of the sealing member C1 and the end portion 10e1 of the development blade 10e due to variations in the accuracy of the parts in the axial direction of the development sleeve 10d, as shown in FIGS. 5(*a*) and 5(*b*) a sealing member C2 provided with bias lip portions 16c1 and 16c2 which is linked with the lip portions 16a1 and 16b2 and protrudes toward the seating surface 17a2 (See FIG. 3) may be used.

In the sealing member C2 shown in FIGS. 5(*a*) and 5(*b*), the lip portions 16c1 and 16c2 are brought into abutment with the seating surface 17a2 of the development frame member, causing the sealing member C2 to be pressed against the longitudinal end portion 10e1 of the development blade 10e. As a result, the lip portions 16a1 and 16b1 are brought into abutment with the end portion 10e1, and therefore, even if there are some variations in the accuracy of the parts, the tower will not leak.

[Third embodiment]

Figure 6:
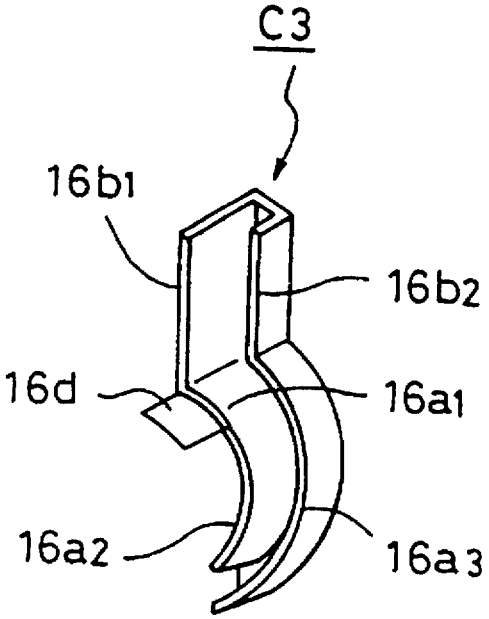
FIG. 6 is an illustration of a sealing member in accordance with a third embodiment of the present invention.
Figure 7:
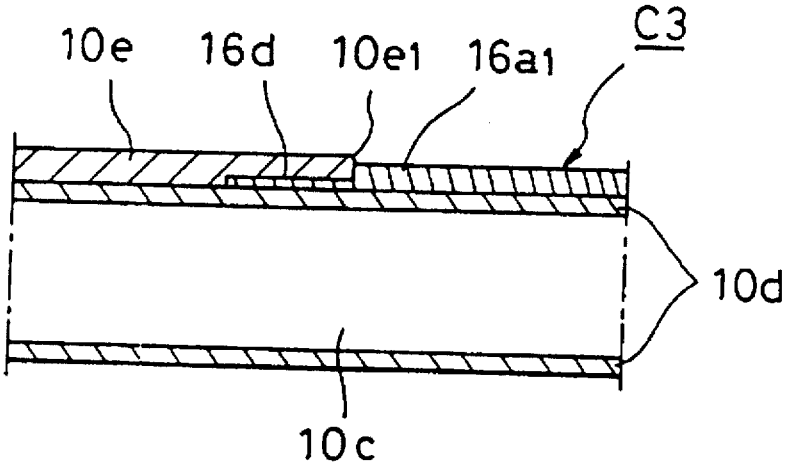
FIG. 7 illustrates a state in which sealing is performed by a sealing member in accordance with the third embodiment of the present invention.

As shown in FIG. 6, a fastened lip portion 16d having a thickness of tens of μm to several hundreds of μm may be provided in the lip portion 16a1 of a sealing member C3 of the above-described first embodiment. This sealing member C3 is, as shown in the longitudinal sectional view of the development sleeve shown in FIG. 7, mounted in such a way that the fastened lip portion 16d is fastened between the development sleeve 10d and the development blade 10e in the vicinity of the longitudinal end portion 10e1 of the development blade 10e.

When the sealing member C3 is used, no gap will be created between the sealing member C3 and the development blade 10e, making it possible to completely prevent the toner from leaking.

Also, when the sealing member C3 is used, since the toner on the development sleeve 10d is scraped off by the fastened lip portion 16d in the vicinity of the longitudinal end portion 10e1 of the development blade 10e, there is no risk that the toner will leak from the gap between the fastened lip portion 16d and the development sleeve 10d.

[Fourth Embodiment]

Figure 8:
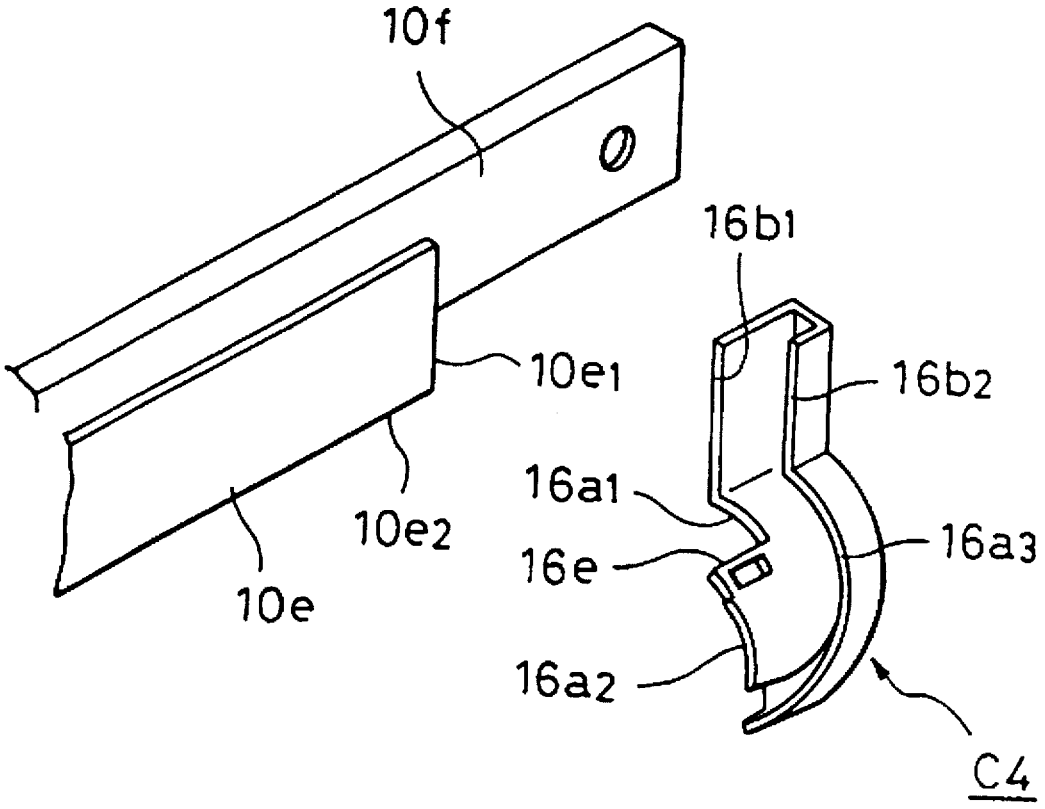
FIG. 8 is an illustration of a sealing member in accordance with a fourth embodiment of the present invention.

In another embodiment of the sealing member, as shown in FIG. 8, a lateral lip portion 16e having a small thickness is provided. The lip portion 16e is brought into elastic abutment with an end portion 10e2 in the vicinity of the short-direction end portion 10e1 of the development blade 10e. Using a sealing member C4 having such a lateral lip portion 16e eliminates the risk that the toner will leak from the longitudinal and lateral end portions 10e1 and 10e2 of the development blade 10e.

[Fifth Embodiment]

Figure 9:
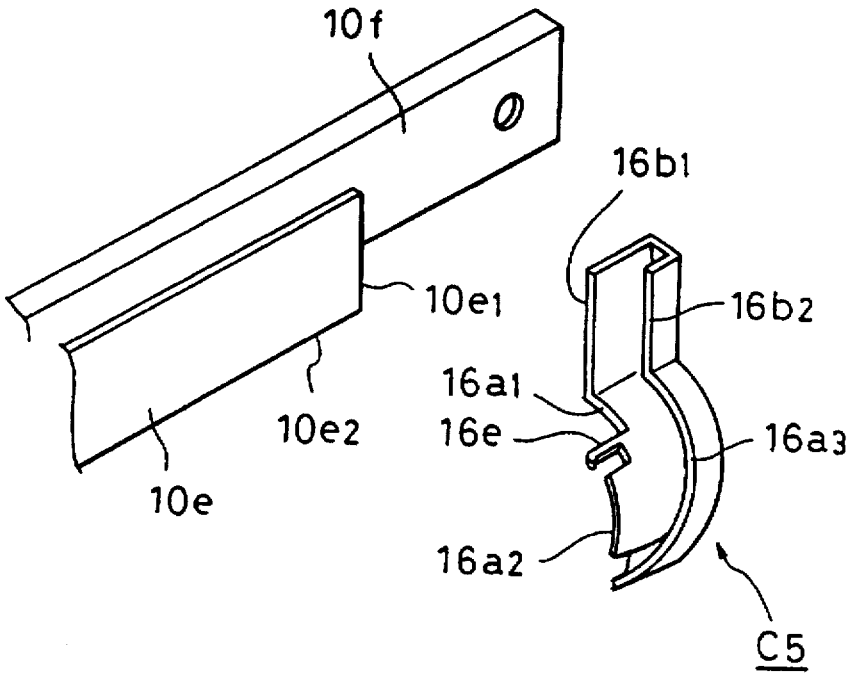
FIG. 9 is an illustration of a sealing member in accordance with a fifth embodiment of the present invention.

Although the sealing member C4 shown in FIG. 8 is formed in such a way that the lip portion 16a2 extends from the lateral lip portion 16e, as shown in FIG. 9, the same advantage can be obtained even if a sealing member C5 is used which is formed in such a way that the lip portion 16e which is brought into elastic abutment with the lateral end portion 10e2 of the development blade 10e does not extend from the lip portion 16a2.

[Sixth Embodiment]

Figure 10A:
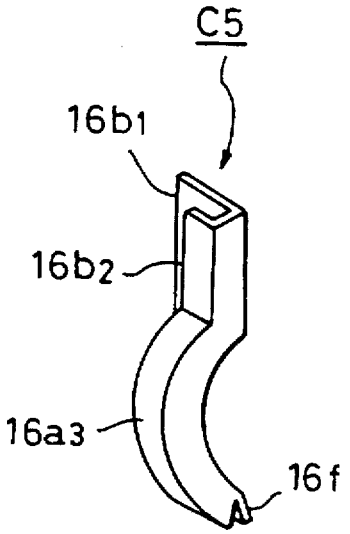
FIGS. 10(*a*) and 10(*b*) are illustrations of a sealing member in accordance with a sixth embodiment of the present invention.
Figure 10B:
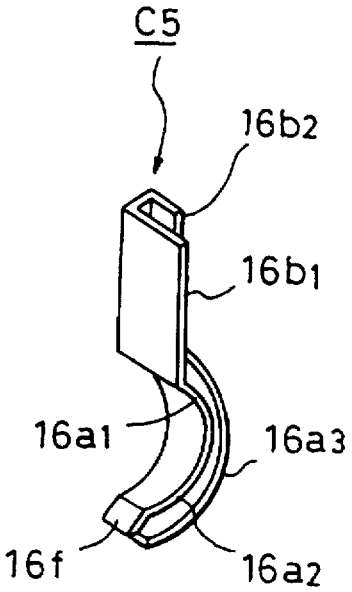
Figure 11:
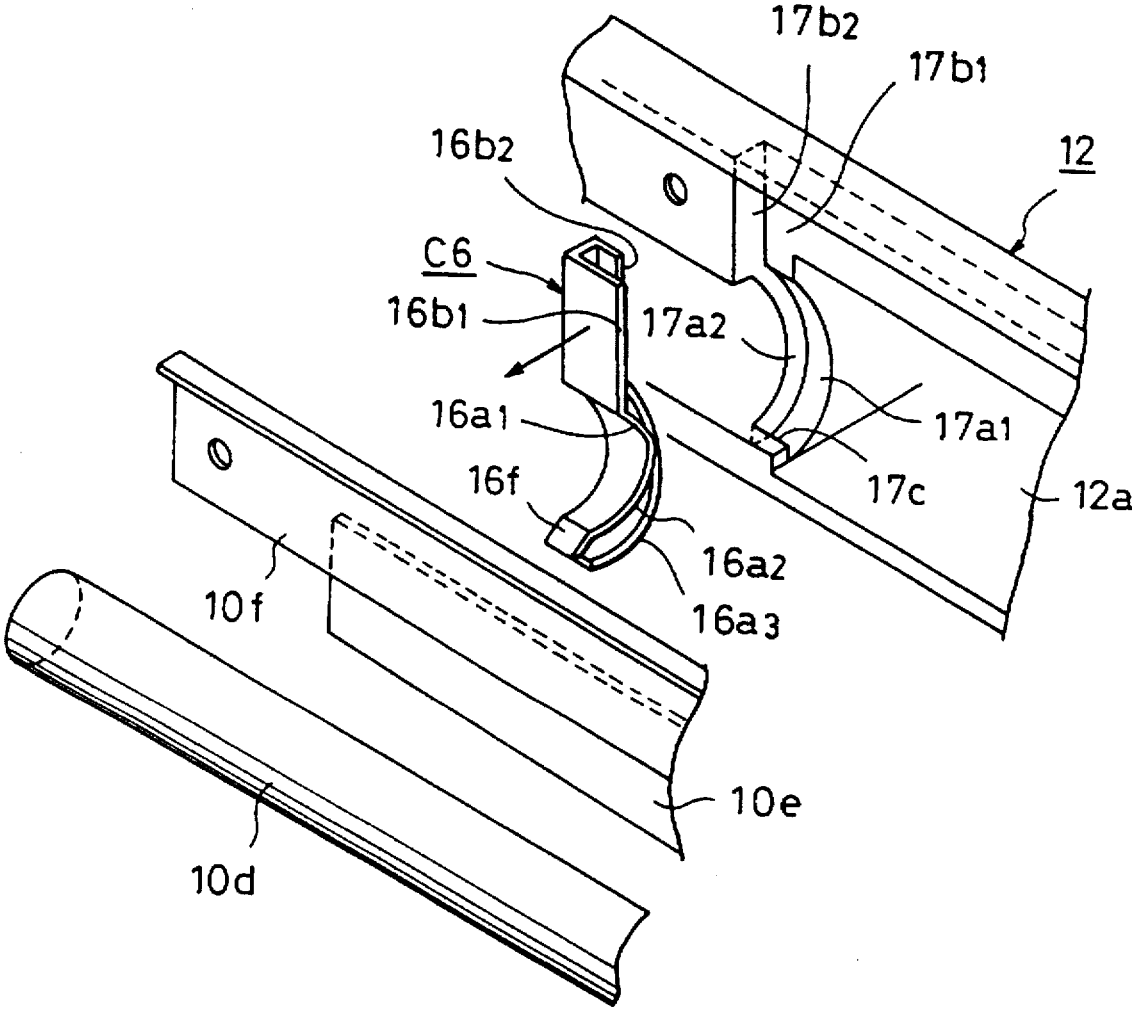
FIG. 11 illustrates a state in which the sealing member of the third embodiment is mounted on a frame member.

In another embodiment of the sealing member, as shown in FIGS. 10(*a*) and 10(*b*), an elastic pressing lip portion 16f may be provided in the end portion of a semi-circular lip portion 16a2. As shown in FIG. 11, an engagement seating surface 17c is provided in the end portion of a semi-circular seating surface 17a1 of the frame member 12 on which a sealing member C6 is mounted so that when the sealing member C6 is mounted, the pressing lip portion 16f presses against the engagement seating surface 17c.

When the sealing member C6 in which the pressing lip portion 16f is provided is mounted as described above, the pressing lip portion 16f is deformed elastically, the sealing member C6 is pressed in the direction of the arrow of FIG. 11 by the reaction force. Therefore, the contact between the lip portion 16b1 and the blade support member 10f increases, increasing the sealing effect.

[Seventh Embodiment]

Figure 12:
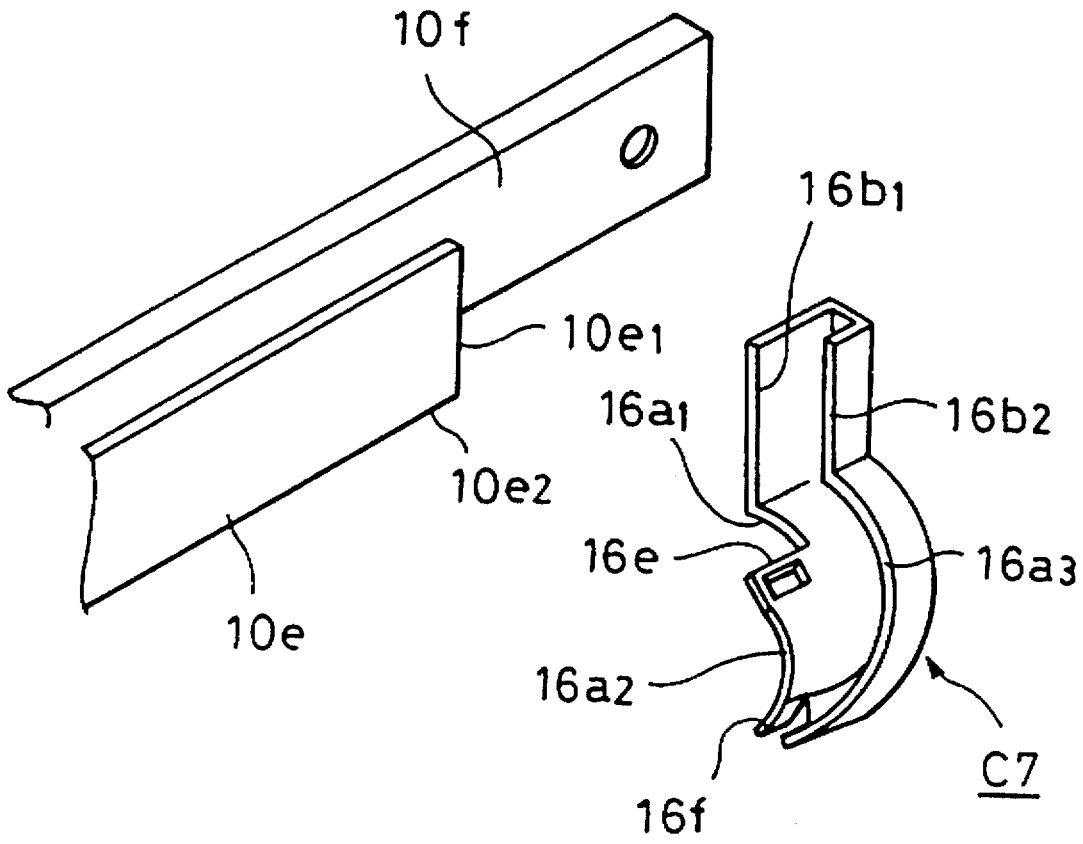
FIG. 12 is an illustration of a sealing member in accordance with a seventh embodiment of the present invention.

Although in the above-described sixth embodiment an example in which the pressing lip portion 16f is provided in the sealing member C1 of the first embodiment is described, the pressing lip portion 16f may be provided in the other sealing members C2 to C5. For example, as shown in FIG. 12, a sealing member C7 in which the pressing lip portion 16f is provided may be used in the end portion of the semi-circular lip portion 16a2 of the sealing member C4 of the above-described fourth embodiment.

[Eighth Embodiment]

Although in the above-described first to seventh embodiments the sealing member used for preventing toner from leaking from the space between the development means and the frame member, it also is possible to use a sealing member of the above-described construction in connection with the cleaning means 11.

Figure 13:
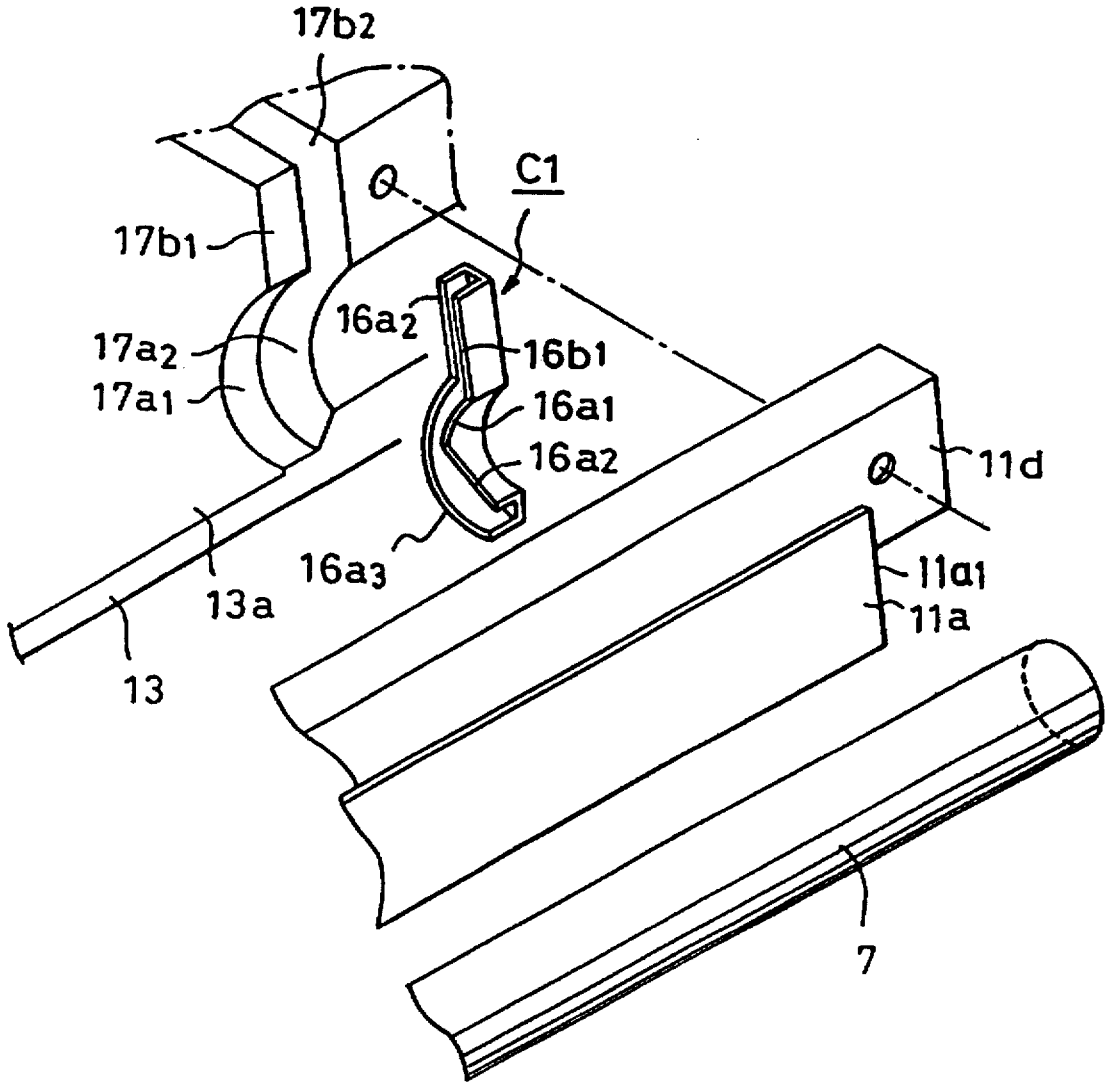
FIG. 13 is an illustration of a sealing member in accordance with an eighth embodiment of the present invention.

More specifically, in the cleaning means 11, as shown in FIG. 13, a cleaning blade 11a supported by a blade support member 11d is brought into abutment with the photosensitive drum 7 so that waste toner is removed. Step portions formed of semi-circular seating surfaces 17a1 and 17a2 and straight-line seating surfaces 17b1 and 17b2 are formed in the longitudinal end portions of a waste toner opening 13a provided in the cleaning frame member 13. The sealing member C1 explained in the first embodiment is engaged with these step portions.

The lip portion 16a1 provided in the semi-circular portion 16a is mounted so as to be brought into abutment with the longitudinal end portion 11a1 of the cleaning blade 11a and the photosensitive drum 7, the lip portion 16a2 is mounted so as to be brought into abutment with the photosensitive drum 7, and the lip portion 16a3 is mounted so as to be brought into abutment with the seating surface 17a1 of the cleaning frame member 13. The lip portion 16b1 provided in the straight-line portion 16b is mounted so as to be brought into abutment with the cleaning blade 11a and the blade support member 11d, and the lip portion 16b2 is mounted so as to be brought into abutment with the seating surface 17b1.

Mounting the sealing member C1 in the above-described way makes it possible to prevent waste toner from leaking from the gap between the cleaning blade 11a and the cleaning frame member 13. The same advantage as those described above also can be obtained if the above-described sealing members C2 to C7 are used in place of the above-described sealing member C1.

[Ninth Embodiment]

Figure 14:
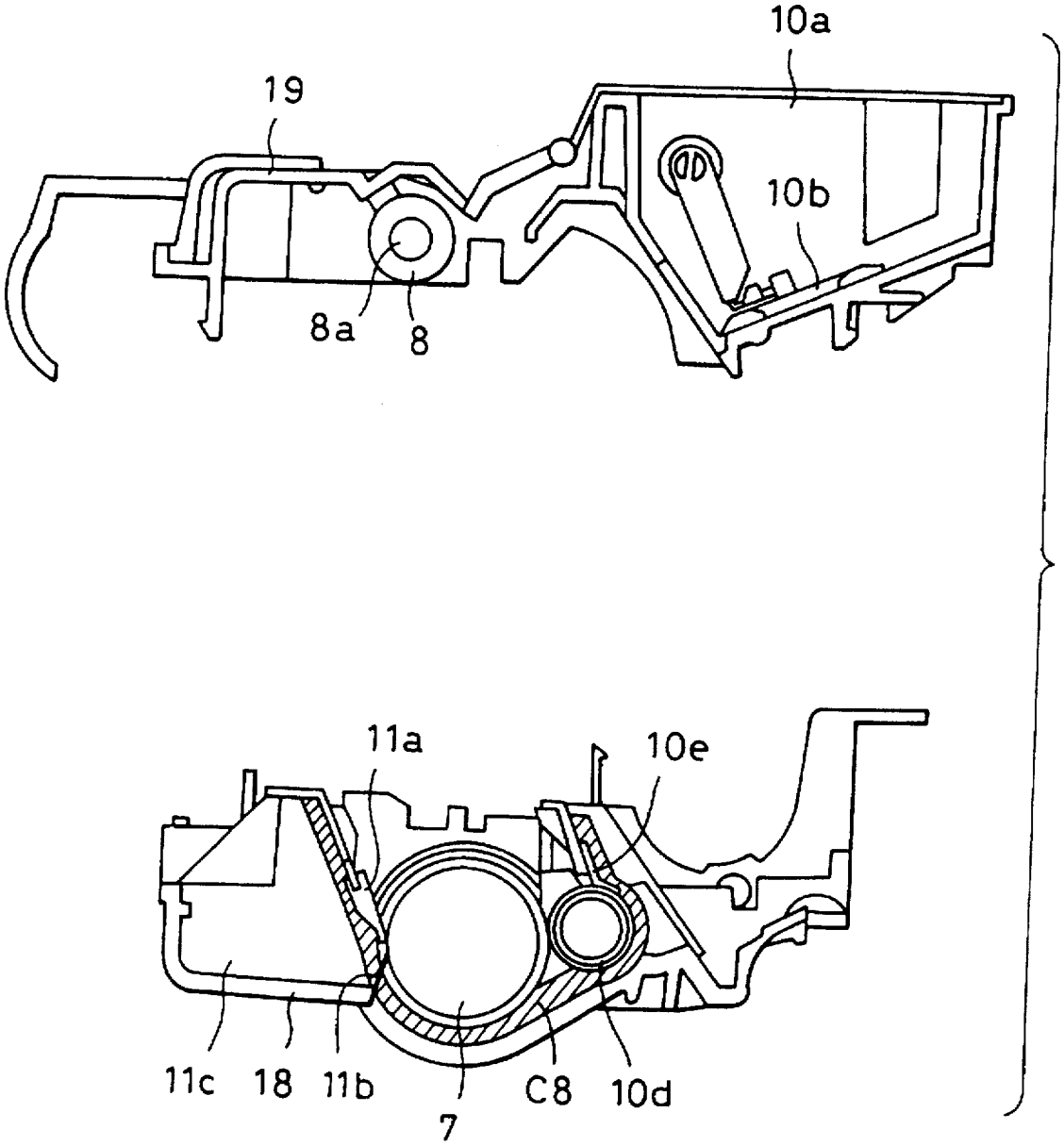
FIG. 14 is a sectional view illustrating a state in which a sealing member of a ninth embodiment is mounted on a frame member.
Figure 15:
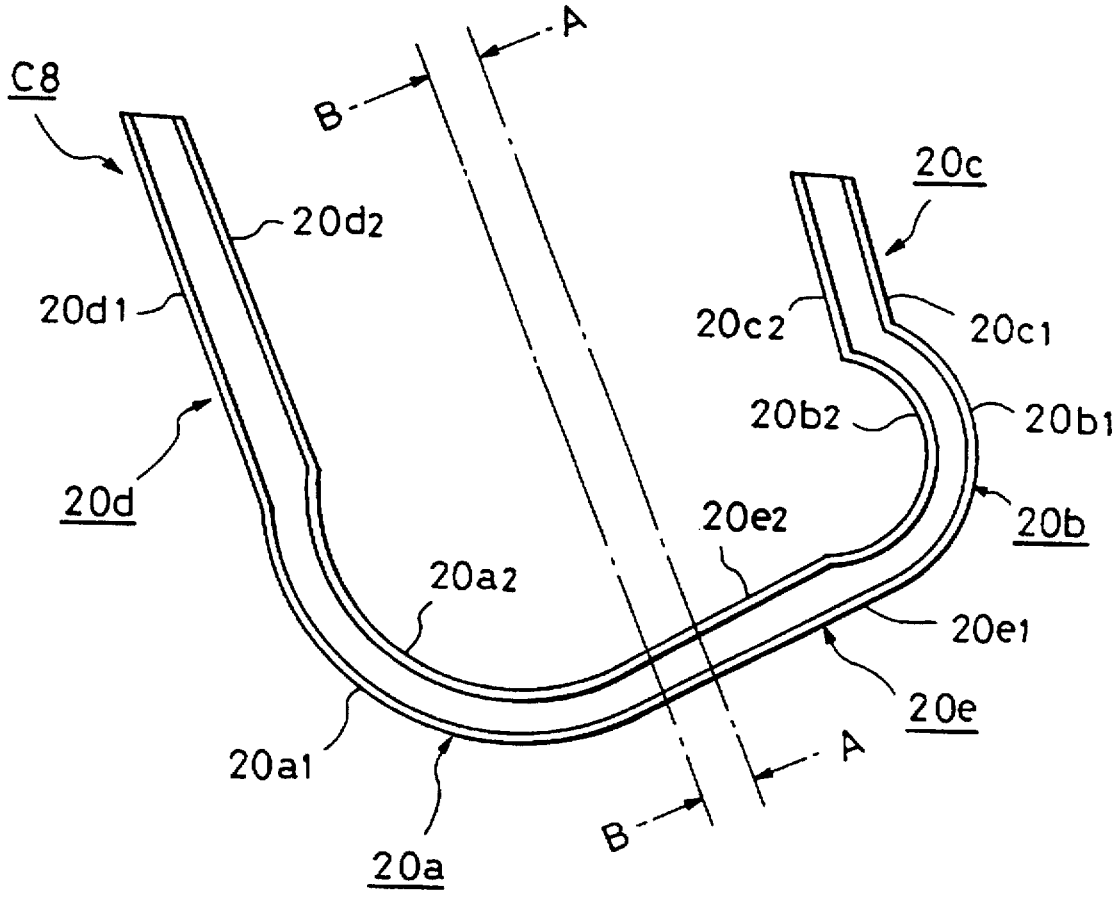
FIG. 15 is an illustration of the construction of a sealing member in accordance with the ninth embodiment of the present invention.
Figure 16A:
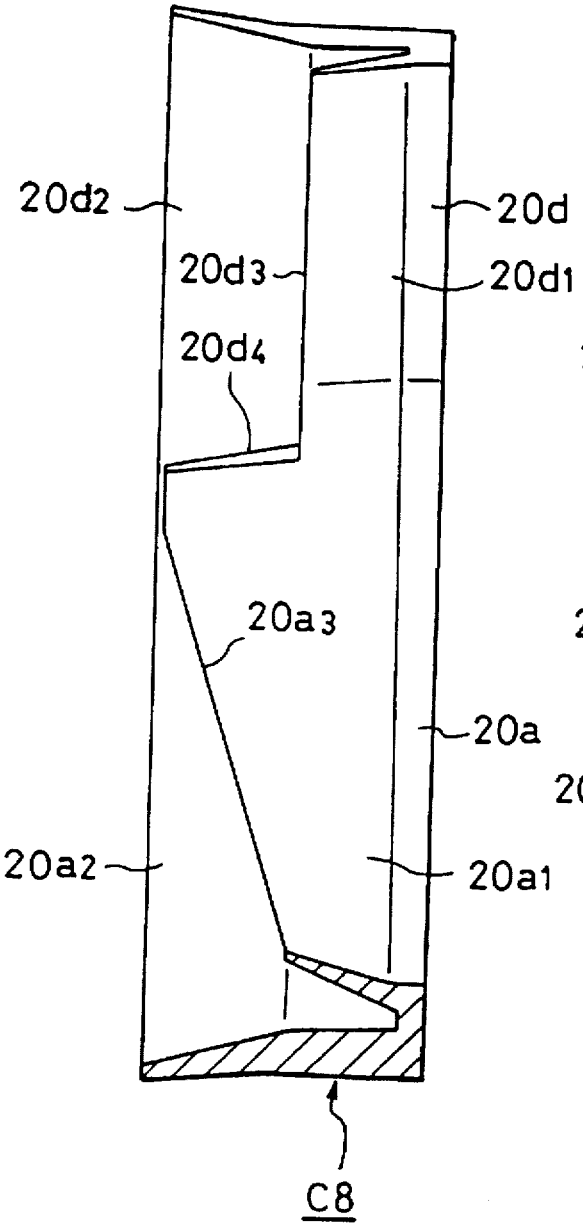
FIG. 16(*a*) is a sectional view taken along line A—A of FIG. 15.
Figure 16B:
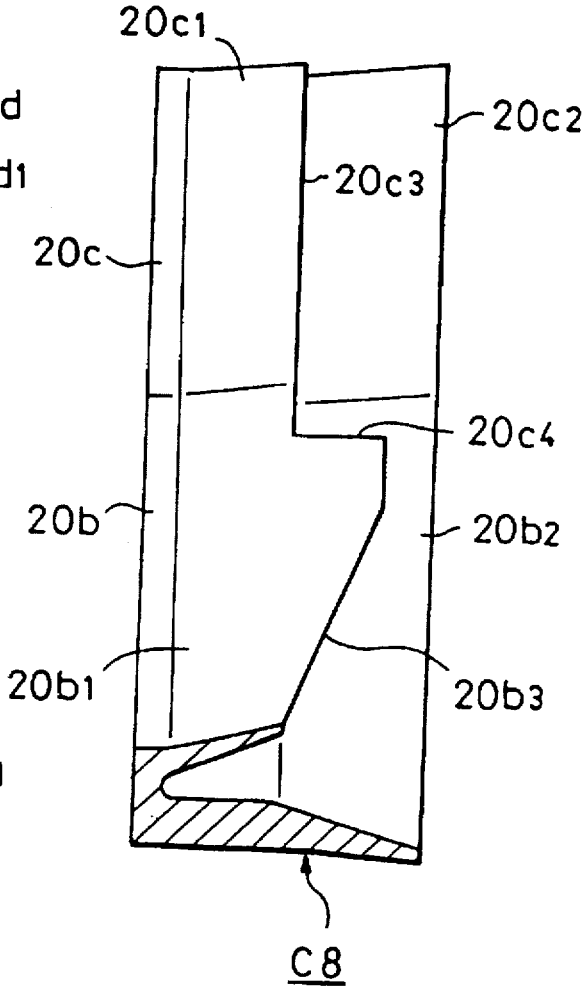

Next, an embodiment in which the photosensitive drum, the developing means and the cleaning means are sealed by an integral member will be explained with reference to FIGS. 14 to 16. FIG. 14 is a sectional view illustrating a state in which a sealing member is mounted on a frame member. FIG. 15 is an illustration of the construction of a sealing member. FIG. 16(*a*) is a sectional view taken along the line A—A of FIG. 15, and FIG. 16(*b*) is a sectional view taken along the line B—B of FIG. 15.

Components in the ninth embodiment which are the same as those in the above-described embodiments are given the same reference numerals.

In this embodiment, the frame member is formed of a lower frame member 18 and an upper frame member 19 so that the frame member can be separated into the upper and lower portions. The photosensitive drum 7, the development sleeve 10*d*, the development blade 10*e*, the cleaning blade 11*a* and the like are mounted on the lower frame member 18.

A sealing member C8 is mounted to prevent toner from leaking outside from the gap formed between the lower frame member 18 and each of the photosensitive drum 7, the development sleeve 10*d*, the development blade 10*e*, and the cleaning blade 11*a*. The sealing member C8, as shown in FIGS. 14 and 15, comprises a drum seal portion 20*a* for sealing the space between the lower frame member 18 and the photosensitive drum 7, a development seal portion for sealing the space between the lower frame member 18 and the development sleeve 10*d* and the development blade 10*e* which constitute the developing means 10 (having a sleeve seal portion 20*b* for sealing the lower frame member 18 and the development sleeve 10*d*, and a blade seal portion 20*c* for sealing the space between the lower frame member 18 and the development blade 10*e*), a cleaning seal portion 20*d* for sealing the space between the lower frame member 18 and the cleaning blade 11*a* which constitutes the cleaning means 11, and a coupling seal portion 20*e* which connects the drum seal portion 20*a* to the sleeve seal portion 20*b*, these elements being formed into one unit by the above-described elastic material such as a soft plastic material or urethane rubber.

The seal portions 20*a* to 20*e* respectively have elastic outer lip portions 20*a*1, 20*b*1, 20*c*1, 20*d*1, and 20*e*1 which are in abutment with the lower frame member 18, and elastic inner lip portions 20*a*2, 20*b*2, 20*c*2, 20*d*2, and 20*e*2 which are in abutment with each of the respective process means described above. Each of the lip portions is elastically brought into abutment with the photosensitive drum 7 and the lower frame member 18 and comes in close contact therewith. As a result, it is possible to reliably prevent the toner from leaking.

As shown in FIG. 16(*a*), the inner lip portion 20*d*1 of the cleaning seal portion 20*d* is formed narrower in width than the outer lip portion 20*d*2. An abutment end portion 20*d*3 with which the longitudinal end portion of the cleaning blade 11*a* is brought into abutment, and an abutment end portion 20*d*4 with which the lateral end portion of the cleaning blade 11*a* is brought into abutment are formed. Further, as shown in FIG. 16(*b*), the inner lip portion 20*c*1 of the development blade seal portion 20*c* is formed narrower in width than the outer lip portion 20*c*2. An abutment end portion 20*c*3 with which the longitudinal end portion of the development blade 10*e* is brought into abutment, and an abutment end portion 20*c*4 with which the lateral end portion of the development blade 10*e* is brought into abutment are formed.

As shown in FIGS. 16(*a*) and 16(*b*), inclined portions 20*a*3 and 20*b*3 are formed in the inner lip 20*a*1 of the drum seal portion 20*a* which is in abutment with the photosensitive drum 7 and the inner lip 20*b*1 of the sleeve seal portion 20*b* which is in abutment with the development sleeve 10*d*, respectively. These inclined portions are used to direct toner to be sealed toward the inside of the photosensitive drum in the direction of its rotation when the photosensitive drum 7 and the development sleeve 10*d* are rotated.

To attach the sealing member C8, the sealing member C8 is placed on the seal seating surface of the lower frame member 18, and the photosensitive drum 7, the development sleeve 10*d*, the development blade 10*e* or the cleaning blade 11*a* may be attached in sequence thereon. Therefore, unlike in the prior art, it is not necessary to perform a difficult operation for attaching a plurality of sealing members onto a curved seating surface. It becomes possible to reduce the number of parts so as to simplify an attachment step. As a result, costs can be reduced, facilitating automatic attachment.

[Tenth Embodiment]

A ninth embodiment, in which the sealing member is formed integral with the frame member, will be explained with reference to FIGS. 17 and 18.

This sealing member C9 is formed of elastic soft plastic, and provided integrally in the lower frame member 18 by two-color molding. In sealing member C9, as shown in FIG. 18, only the inner lip portion in the ninth embodiment is formed, and this inner lip portion is molded integrally with the lower frame member 18.

If the sealing member C9 is molded integrally with the frame member as described above, unlike in the prior art, there is no possibility that toner will leak from the space between the sealing member and the frame member. Also, the number of parts is reduced, and the sealing of the sealing member C9 is unnecessary, making the step for installing cartridges simpler.

Figure 17:
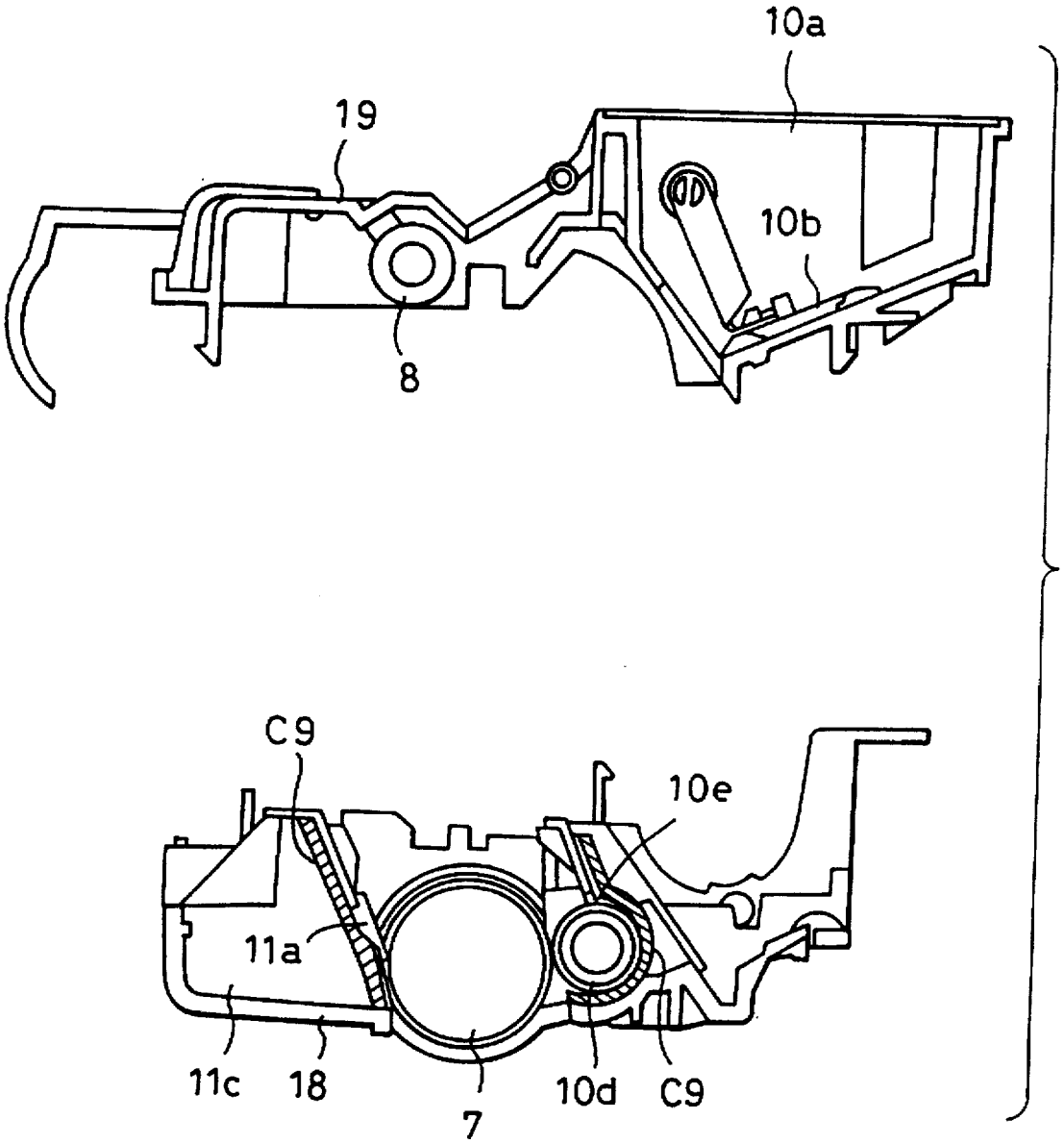
FIG. 17 is a sectional view illustrating a state in which a sealing member of a tenth embodiment is mounted on a frame member.
Figure 18:
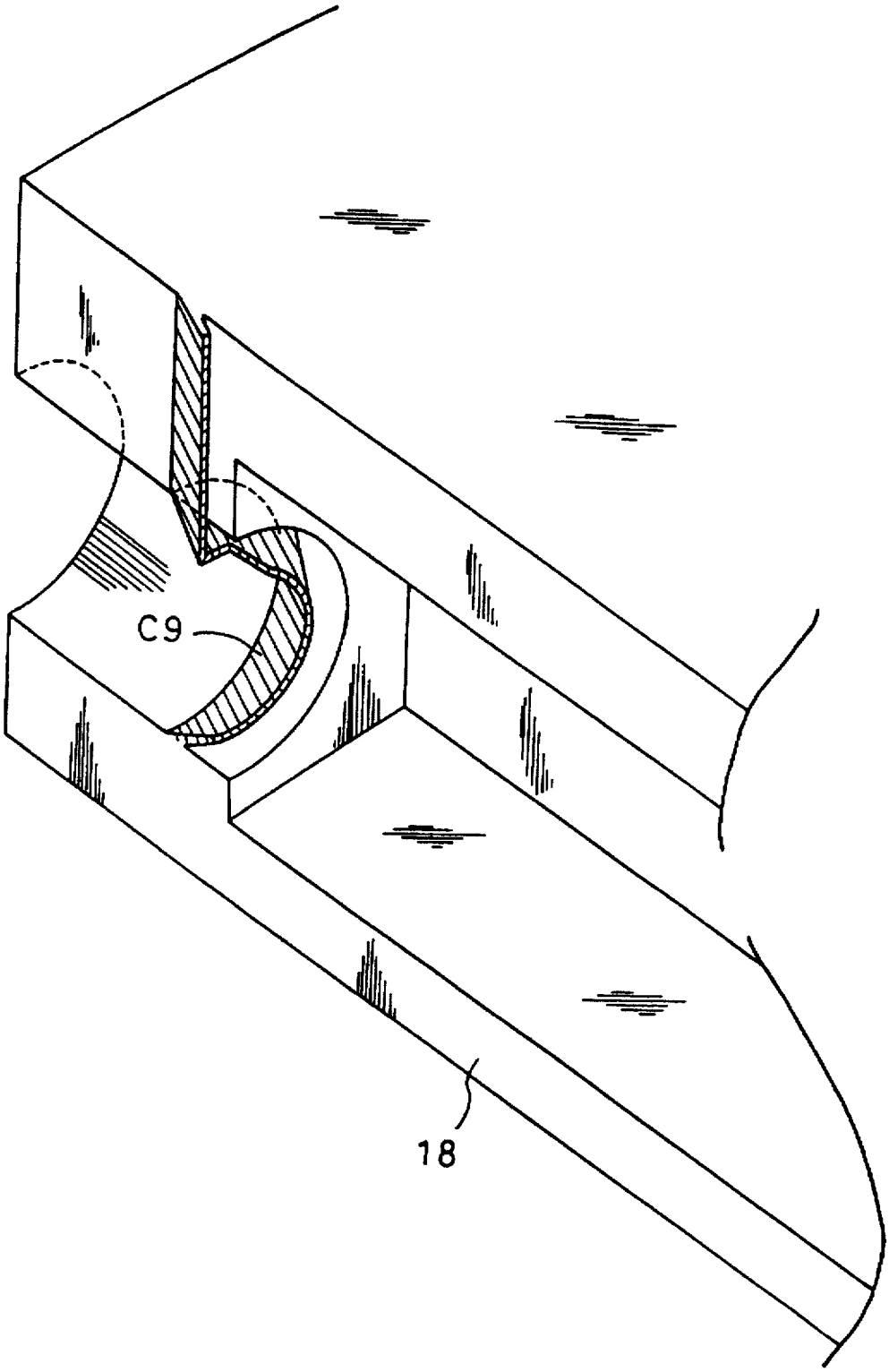
FIG. 18 is an illustration of the construction of a sealing member in accordance with the tenth embodiment of the present invention.
Figure 19:
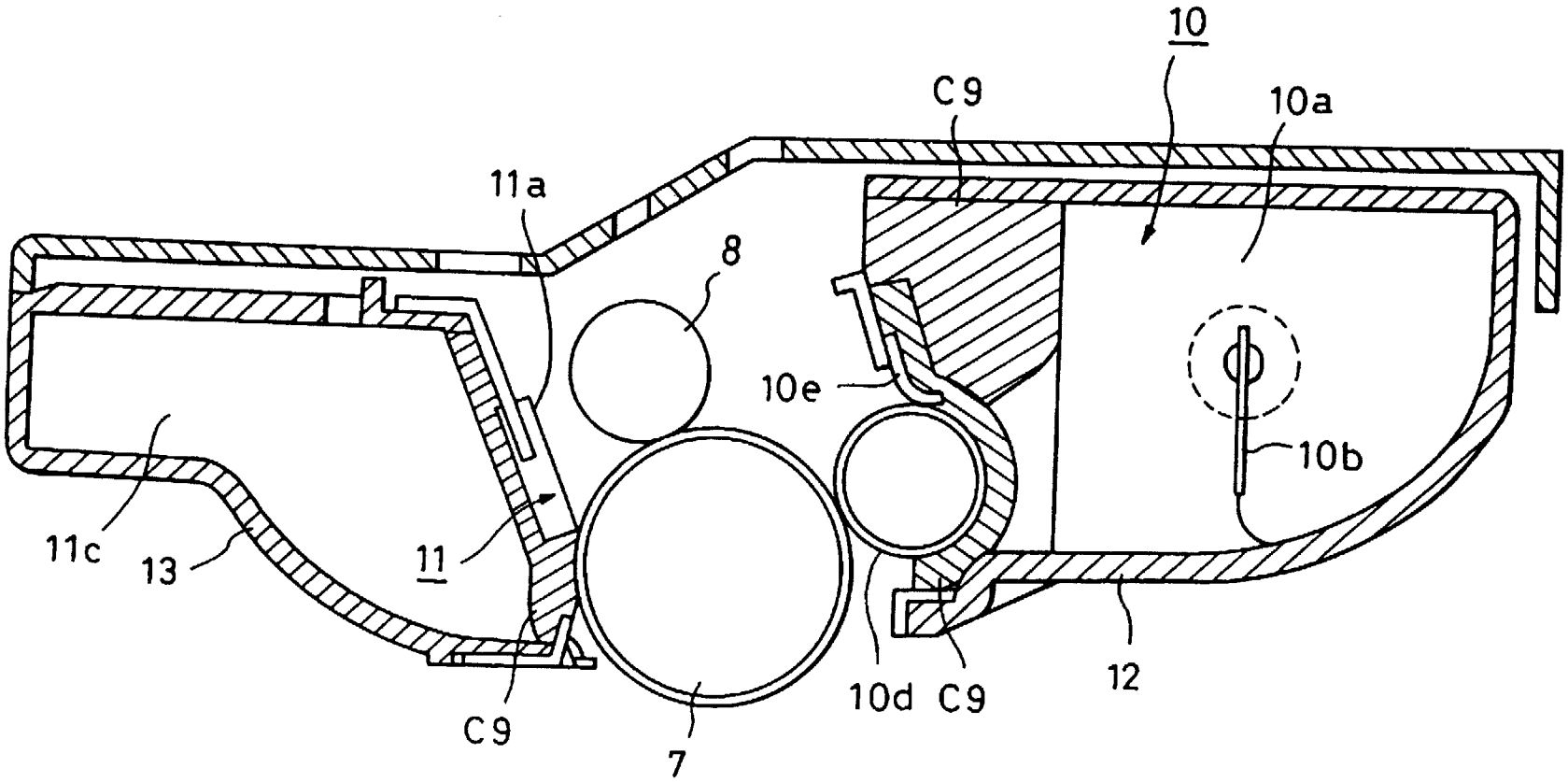
FIG. 19 illustrates a state in which the sealing member of the tenth embodiment is loaded into a process cartridge having a development frame member and a cleaning frame member.

Also, in the case of sealing member C9 of this embodiment, in addition to the above arrangement in which the upper and lower frame members 18 and 19 are separated into upper and lower portions, as shown in FIG. 17, it is possible to integrally provide the sealing member C9 in respective frame members 12 and 13 of a cartridge which can be separated into the frame member 12, including the developing means 10, and the cleaning frame member 13, including the photosensitive drum 7 and the cleaning means 11, as shown in FIG. 19.

[Eleventh embodiment]

Engagement means may be provided in the above-described embodiments, so that a sealing member will not deviate from the required position when a separate sealing member is used with the frame member and another member attached in the frame member (other than the embodiment in which the sealing member is integrally formed with the frame member as shown in ninth embodiment).

Figure 20:
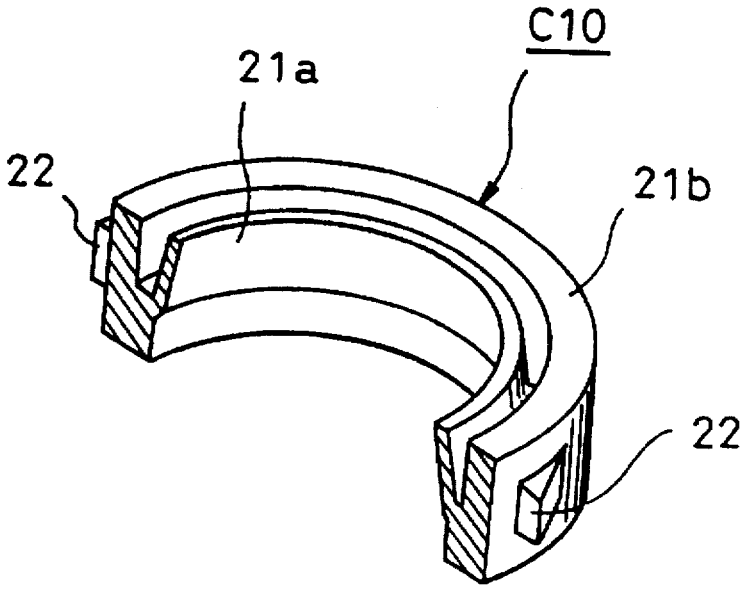
FIG. 20 is an illustration of the construction of a sealing member in accordance with an eleventh embodiment of the present invention.
Figure 21:
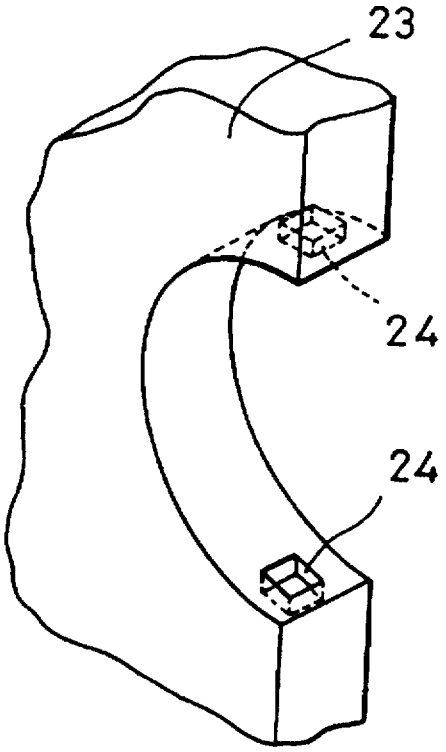
FIG. 21 is an illustration of a seating surface by which the sealing member of the eleventh embodiment is mounted.

As shown in FIGS. 20 and 21, for example, in one embodiment an engagement projection 22 is provided on the outer peripheral surface of a sealing member C10 having an inner lip portion 21*a* and an outer lip portion 21*b*, and an engagement recess 24 with which the engagement projection 22 can be engaged is provided on the seating surface of a frame member 23 into which the sealing member C10 is installed. When the elastic sealing member C10 formed of soft plastic, urethane rubber or the like is installed into the seating surface, the sealing member C10 is bent so that the engagement projection 22 is engaged with the engagement recess 24. As a result, it is possible to prevent any positional deviation of the sealing member C10 relative to the seating surface and to prevent the sealing member C10 from being detached during an attaching step.

To increase the contact between the sealing member C10 and the seating surface of the frame member, the dimension of the outer diameter of the sealing member C10 may be slightly larger than the abutment dimension of the seating surface so that the inner lip portion 21*a* is elastically brought into abutment with the development sleeve or the like.

Figure 22:
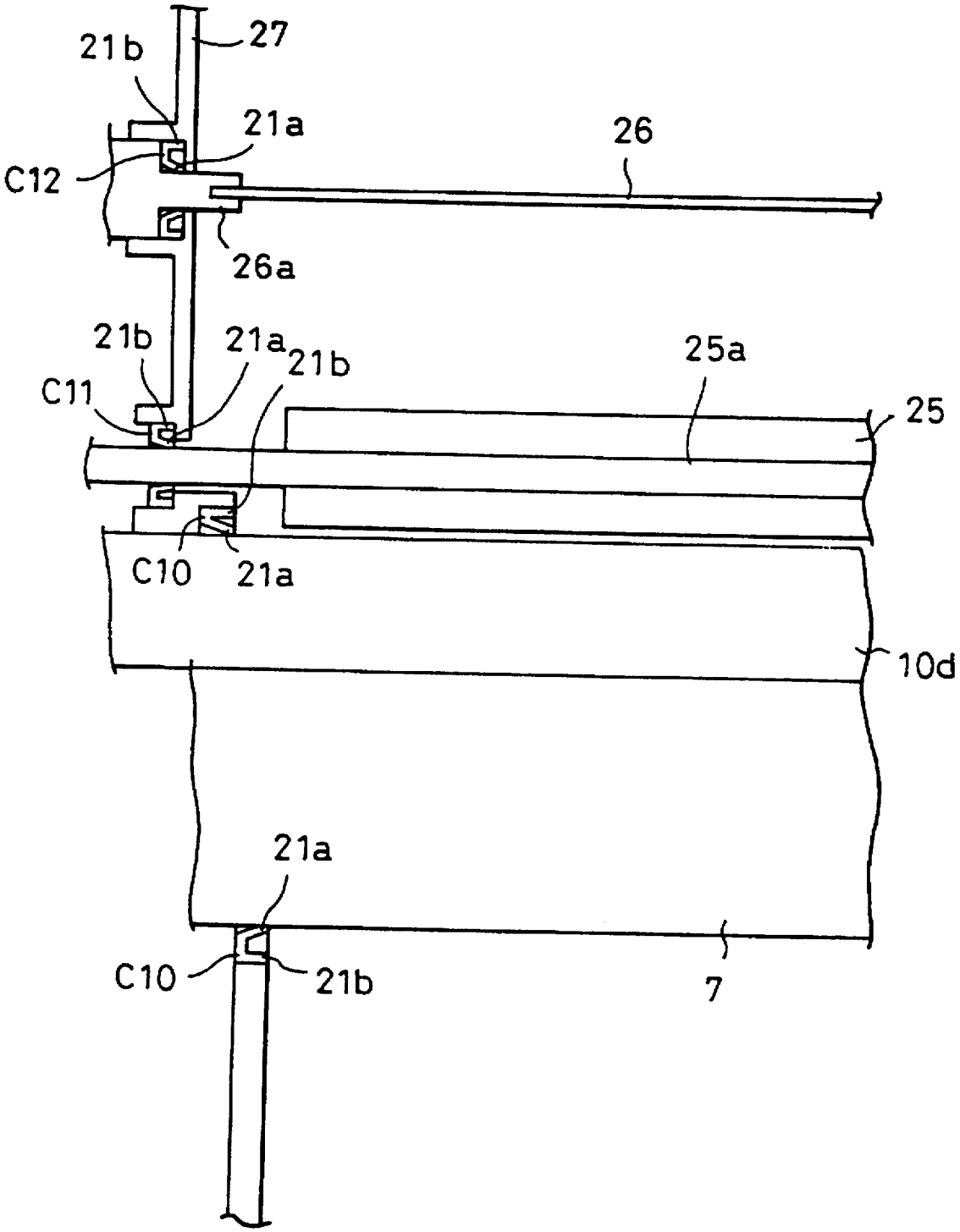
FIG. 22 is an illustration of the position at which the process cartridge having coating rollers and a toner supply blade is sealed.
Figure 23:
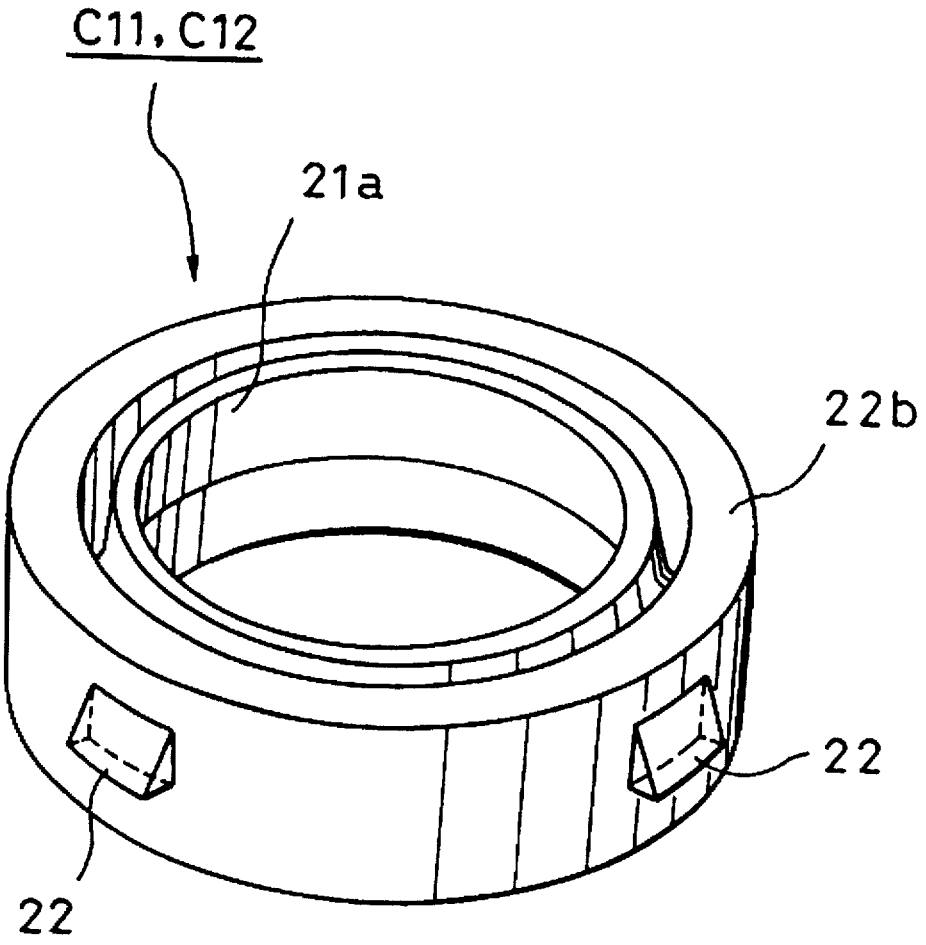
FIG. 23 is an illustration of an embodiment in which engaging projections are provided on the outer peripheral surface of a ring-shaped sealing member.

The semi-circular sealing member C10 shown in FIG. 20 is used to prevent toner from leaking from a space formed between a cylindrical member such as the photosensitive drum or the development sleeve, and the frame member. As shown in FIG. 22, in a process cartridge having an application roller 25 for supplying toner to the development sleeve 10*d* and having a toner supply blade 26 as a toner supply member, it is necessary to provide a sealing member C11 between a rotary shaft 25*a* of the application roller 25 and a frame member 27 and to provide a sealing member C12 between a rotary shaft 26*a* of the toner supply blade 26 and the frame member 27. These sealing members C11 and C12 are, as shown in FIG. 23, formed in a ring shape and have an inner lip portion 21*a* and an outer lip portion 21*b*, and an engagement projection 22 is provided on the outer peripheral surface thereof. When the sealing members C11 and C12 are engaged with a seating surface of the frame member in which the engagement recesses are formed, the sealing members C11 and C12 are securely fixed, making it possible to reliably prevent toner leakage.

Figure 24:
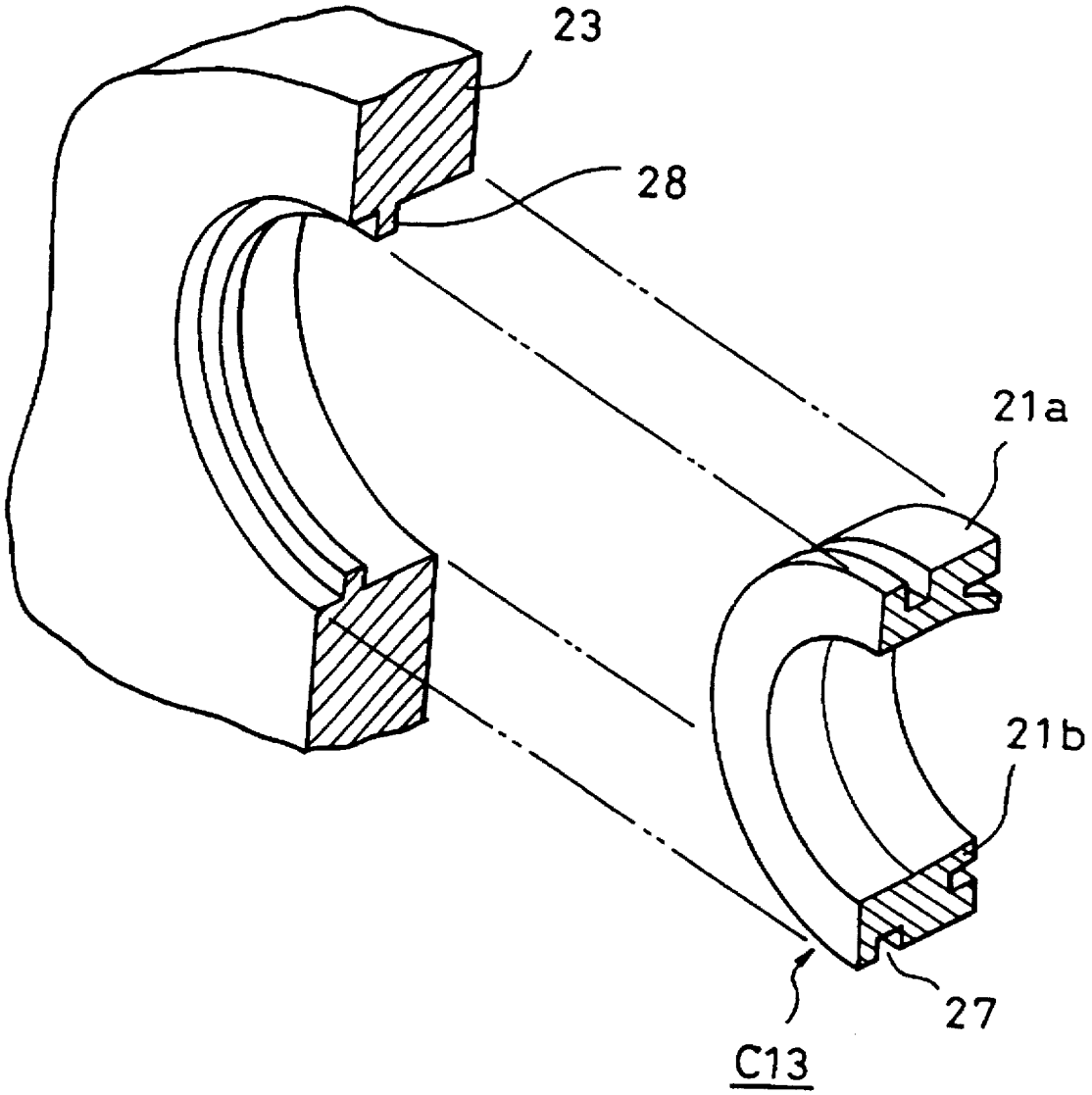
FIG. 24 is an illustration of an embodiment in which engaging recesses are provided on the outer peripheral surface of the sealing member.

Although an example has been described in which the engagement projection 22 is provided on the outer peripheral surface of the sealing member C10 shown in FIG. 21 and the engagement recess 24 is provided on the seating surface of the frame member thereof, as shown in FIG. 24, it is possible to securely fix the sealing member if an engagement recess 27 is provided on the outer peripheral surface of a sealing member C13 and if an engagement projection 28 capable of being engaged with the engagement recess 27 is provided on the seating surface of the frame member 23.

[Twelfth Embodiment]

Figure 25:
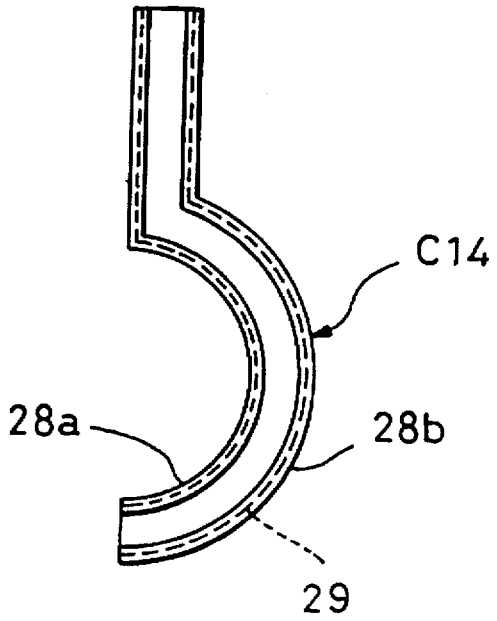
FIG. 25 is an illustration of an embodiment of a sealing member including a magnetic substance.
Figure 26:
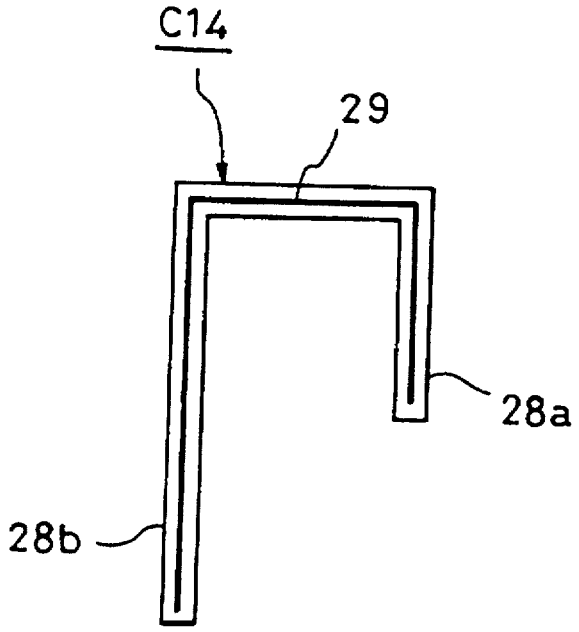
FIG. 26 is an illustration of an embodiment of a sealing member including a magnetic substance.

Each of the sealing members C1 to C13 of the above-described embodiments is formed of a material, such as soft plastic (e.g., POM, PP, PE, nylon, or tetrafluoroethylene) or urethane rubber. However, as shown in FIGS. 25 and 26, a magnetic member 29 may be provided inside a sealing member C14 having an inner lip portion 28*b* and formed of soft plastic. If this is done there is a resulting advantage, namely, since the magnetic toner is adbsorbed into the sealing member C14 having the magnetic member 29, it is possible to securely prevent toner leakage in the seal portion.

In addition to the construction in which a magnetic member 29 is contained in the sealing member, the same advantage as above can be obtained using a construction in which a magnetic material is mixed into the soft plastic which constitutes the sealing member. Examples of suitable magnetic materials include ferrite, samarium cobalt (rare earth), and neo-magnetic iron. The percentage of the magnetic material mixed into the soft plastic depends upon the magnetic force to be obtained. When a strong magnetic force is to be obtained, the percentage to be mixed may be set from approximately 80 to 90% in terms of weight ratio, and when a weak magnetic force is sufficient, the percentage to be mixed may be set from approximately 10 to 20%, or less.

[Thirteenth embodiment]

Figure 27:
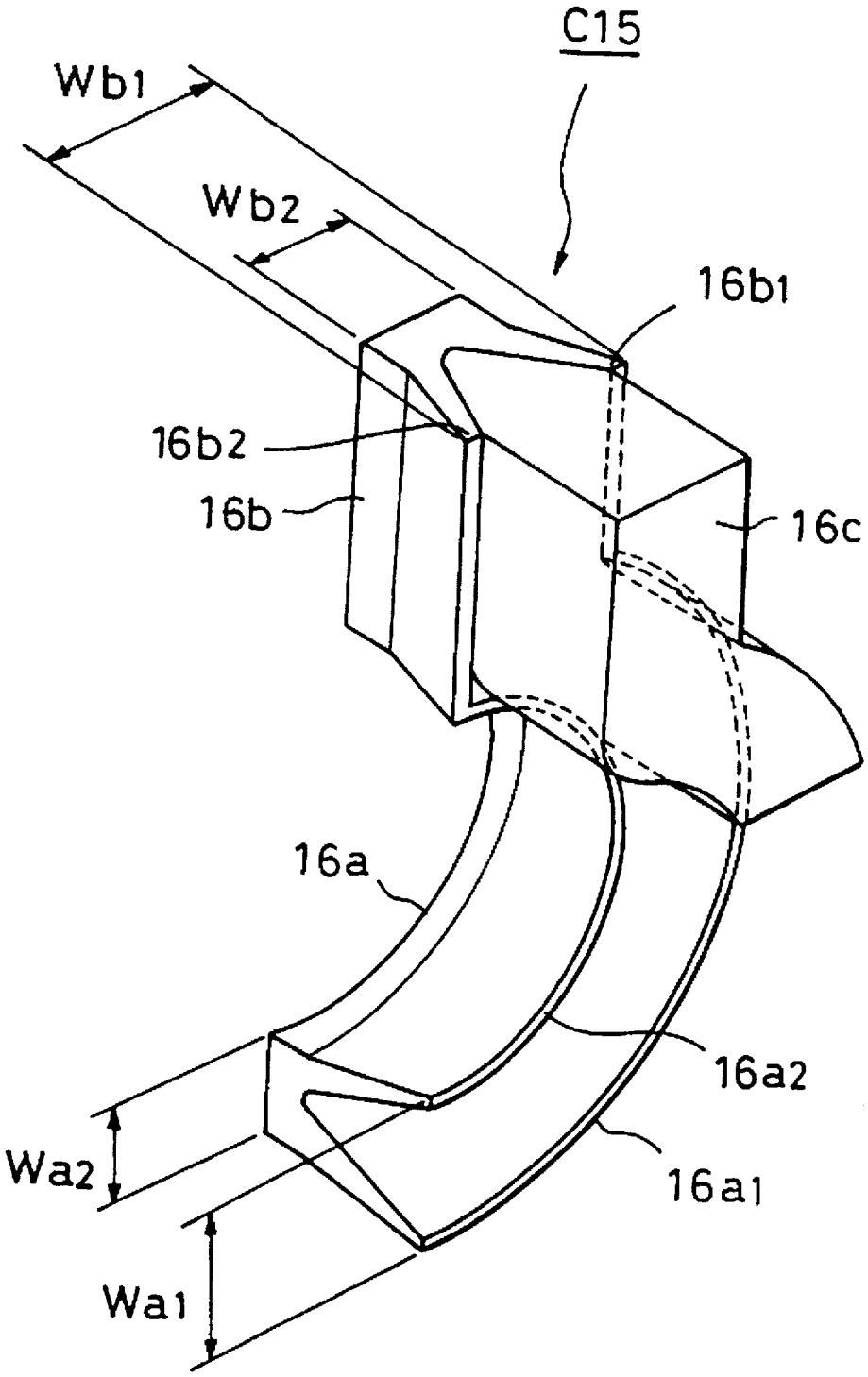
FIG. 27 is an illustration of the construction of a sealing member in accordance with a thirteenth embodiment of the present invention.

A sealing member C15, as shown in FIG. 27, comprises a circular rotary seal portion 46*a*, a straight-line blade seal portion 46*b* which is linked with the circular rotary seal portion 46*a*, and a compressed seal portion 46*c* surrounding the circular rotary seal portion 46*a* and the straight-line blade seal portion 46*b*.

The circular rotary seal portion 46*a* has a circular shape and is capable of being brought into abutment with a development sleeve 40*d*, which is a rotary member. Lip portions 46*a*1 and 46*a*2 are formed to have a V-shaped cross section. The blade seal portion 46*b* is formed integral with the rotary seal portion 46*a*. Lip portions 46*b*1 and 46*b*2 in this blade seal portion 46*b* are also formed in such a way that they have a V-shaped cross section. The circular rotary seal portion 46*a* and the blade seal portion 46*b* are formed of soft plastic (e.g., POM, PP, PE, nylon, or tetrafluoroethylene).

The compressed seal portion 46*c* is provided in such a way that it stretches over a part of the blade seal portion 46*b* and a part of the rotary seal portion 46*a*, to be specific, over slightly below the lateral end of a blade 40*e* when the sealing member C15 is mounted on the blade 40*e*. This compressed seal portion 46*c* is formed of a compressed elastic member (e.g., rubber-based sponge, urethane foam, or felt). The compressed seal portion 46*c* is inserted into and bonded to the respective V-shaped portions of the blade seal portion 46*b* and the rotary seal portion 46*a* by a bonding agent, or mounted by two-color molding or the like.

Figure 28:
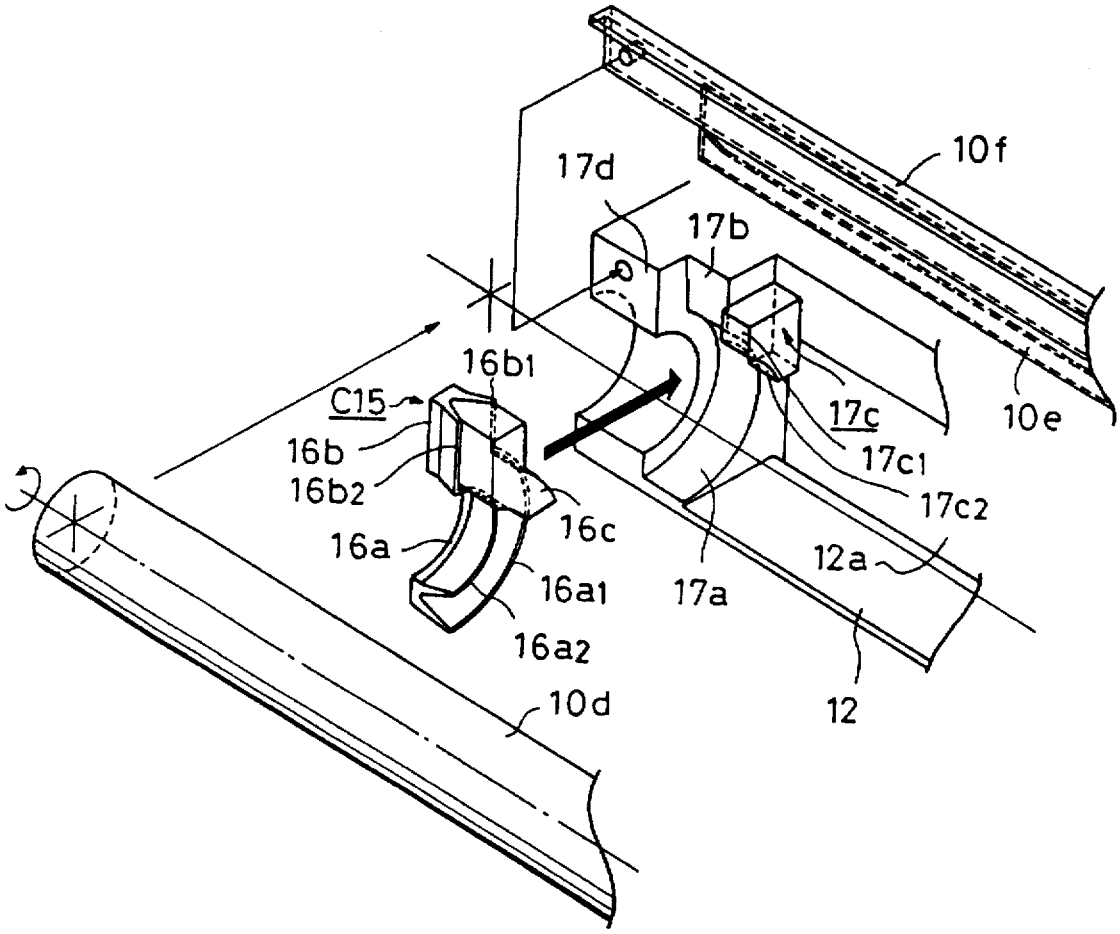
FIG. 28 is an illustration of how the sealing member of the thirteenth embodiment is attached.

Next, a description will be given of the seal seating surface of a frame member 42 in which the sealing member C15 is mounted. An opening 42*a* through which toner in a toner well 40*a* is guided to the development sleeve 40*d* is provided in the frame member 42. A seal seating surface is provided in the longitudinal end portions of the opening 42*a* (only one of the end portions is shown in FIG. 28).

A seating surface 47*a* for the rotary seal portion 46*a* by which the space between the development sleeve 40*d* and the frame member 42 is sealed is formed into a circular surface having a radius slightly larger than the outer diameter of the development sleeve 40*d*. A flat seating surface 47*b* for the blade seal portion 46*b* for sealing the space between a blade support member 40*f* and the frame member 42 is linked with the circular seating surface 47*a*, and positioned slightly below a mounting surface 47*d* of the blade support member 40*f* so as to be spaced from the development blade 40*e*.

The gap between the circular seating surface 47*a* and the development sleeve 40*d* is formed narrower than the width Wa1 of the tip of the lip portion of the rotary seal portion 46*a* shown in FIG. 27 and wider than the width Wa2 of the seal base portion thereof. The gap between the straight-line seating surface 47*b* and the blade support member 40*f* is formed narrower than the width Wb1 of the tip of the lip portion of the rotary seal portion 46*b* shown in FIG. 27 and wider than the width Wb2 of the seal base portion thereof.

Therefore, when the sealing member C15 is mounted on the circular seating surface 47*a* and the straight-line seating surface 47*b* and when the development sleeve 40*d* and the blade support member 40*f* are mounted, lip portions 46*a*1 and 46*a*2 of the rotary seal portion 46*a* are securely brought into abutment with the circular seating surface 47*a* and the development sleeve 40*d*, and the lip portions 46*b*1 and 46*b*2 of the blade seal portion 46*b* are securely brought into abutment with the straight-line seating surface 47*b* and the blade support member 40*f*. As a result, these portions are securely sealed.

A seating surface 47*c* for the compressed seal portion 46*c* used for sealing the space between the longitudinal end portion of the development blade 40*e* and the frame member 42 is formed of a straight-line portion 47*c*1 and a circular portion 47*c*2. These seating surfaces protrude toward the development sleeve 40*d* and the development blade 40*e* slightly more than the circular seating surface 47*a* and the straight-line seating surface 47*b*.

When the sealing member C15 is attached to such seating surfaces 47*a*, 47*b* and 47*c* and the development sleeve 40*d* and the development blade 40e are attached, the lip portions 46a1, 46a2, 46b1 and 46b2 come into close contact with the development sleeve 40d and the blade support member 40f, making it possible to prevent toner from leaking from the gap between them.

In the space between the longitudinal end portion of the development blade 40e and the frame member 42, the compressed seal portion 46c is contacted so as to cause the vicinity of the longitudinal end portion of the development blade 40e to be pressed from the frame member 42, and the compressed seal portion 46c is sufficiently crushed in the space between the straight-line portion 47c1 and the circular portion 47c2 of the seating surface 47c and the frame member 42, thus securely sealing the space between the development blade 40e and the frame member 42.

By using the sealing member C15, it is possible to seal, in addition to the development sleeve 40d and the blade support member 40f, the longitudinal end portion of the development blade 40e. Therefore, unlike in the prior art, there is no risk that toner will enter from the space between two sealing members so that leakage of toner occurs, thus making it possible to obtain more reliable sealing properties. In addition, since it is only necessary to attach the sealing member C15 to the seating surface of the frame member 42, attachment requirements is made considerably simpler.

[Fourteenth Embodiment]

Whereas the above-described sealing member C15 is used to prevent toner from leaking from a space formed between the frame member 42 and the development sleeve 40d, it is also possible to prevent toner from leaking from any section including a cleaning frame member 43, a photosensitive drum 37, and the cleaning blade 41a.

Figure 29:
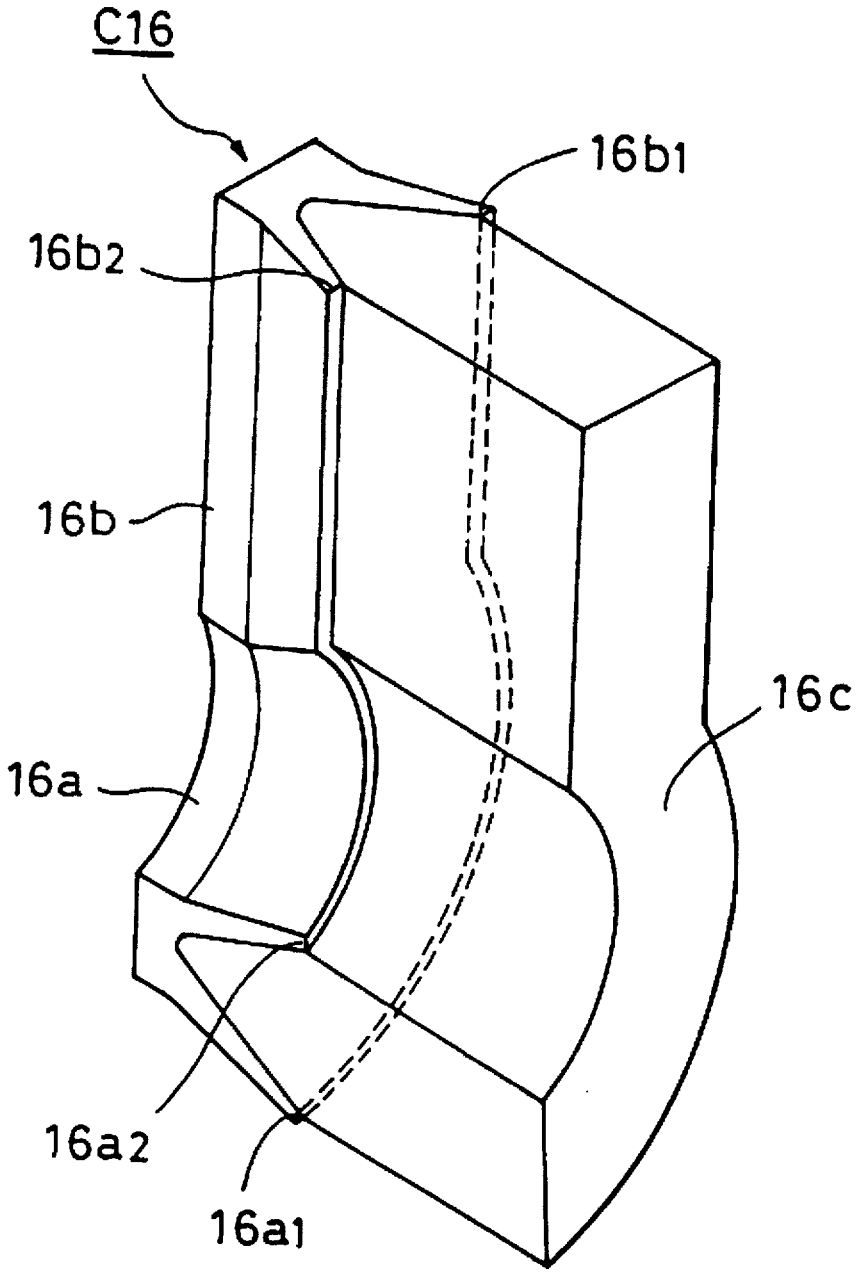
FIG. 29 is an illustration of the construction of a sealing member in accordance with a fourteenth embodiment of the present invention.

A sealing member for the above embodiment will be explained with reference to FIGS. 29 and 30.

In the cleaning means 11, toner sealing in the abutment portion of the photosensitive drum 7 is sufficiently performed by the cleaning blade 41a and the skimming sheet 41b is brought into abutment with the photosensitive drum 7. However, since a gap is created among the photosensitive drum 7, the cleaning blade 41a, the skimming sheet 41b and the cleaning frame member 43 in the longitudinal end portion of the cleaning blade 41a, a sealing member C16 shown in FIG. 29 is attached to the above abutment portion.

The sealing member C16 has basically the same construction as that of the sealing member C15 explained in the thirteenth embodiment. A circular seal portion 46a formed of a soft plastic material and a straight-line blade seal portion 46b are formed integrally. The seal portions 46a and 46b have lip portions 46a1 and 46a2, and 46b1 and 46b2, respectively, and are formed to have a V-shape cross section. A compressed seal portion 46c formed of a compressed elastic member is mounted on the seal portions 46a and 46b by bonding or two-color molding.

However, since a small portion of the sealing member C16 contacts the photosensitive drum 7, the rotary seal portion 46a is shorter than that of the thirteenth embodiment, and the compressed seal portion 46c is provided to stretch over all of the rotary seal portion 46a and the blade seal portion 46b instead of over only respective parts thereof. By such a construction, toner is prevented from leaking from the longitudinal end portion of a skimming sheet 41b attached to a cleaning frame member 43.

Figure 30:
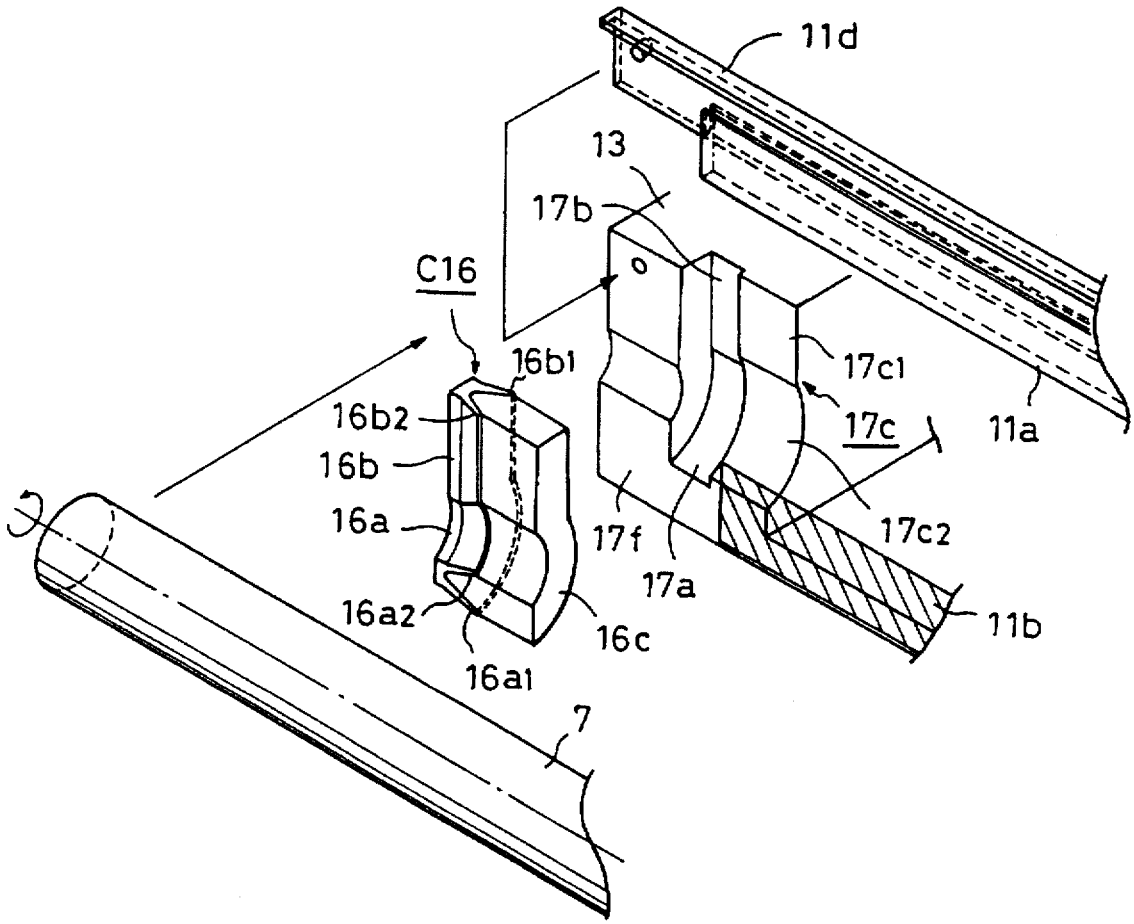
FIG. 30 is an illustration of how the sealing member of the fourteenth embodiment is attached.

Therefore, in the seating surface provided in the cleaning frame member 43, to which surface the sealing member C16 is attached, as shown in FIG. 30, a circular portion 47c2 of the seating surface 47c with which the compressed seal portion 46c abuts stretches from the surface 47f flush with the circular seating surface 47a to the straight-line portion 47c1. The seating surface 47c protrudes toward the photosensitive drum 7 and the cleaning blade 41a slightly more than the circular seating surface 47a and the straight-line seating surface 47b.

As a result of the sealing member C16 being attached to the seating surface provided in the cleaning frame member 43, the lip portion 46a1 come into close contact with the circular seating surface 47a, and the lip portion 46b1 comes into close contact with the straight-line seating surface 47b. Further, the lip portion 46a2 comes into close contact with the photosensitive drum 7, and the lip portion 46b2 comes into close contact with a blade support member 41d. As a result, it is possible to securely prevent toner from leaking from any section including the frame member 43, the photosensitive drum 7 and the blade support member 41d.

In the space between the frame member 43 and the longitudinal end portions of the cleaning blade 41a and the skimming sheet 41b, the compressed seal portion 46c is sufficiently crushed in the space between the seating surface 47c and the cleaning blade 41a to come into close contact with the longitudinal end portions of the cleaning blade 41a and the skimming sheet 41b, thus making it possible to securely prevent toner from leaking from this section. As described above, use of the sealing member C16 makes it possible to securely prevent toner from leaking from the portion of the cleaning frame member 43.

[Fifteenth Embodiment]

Figure 31:
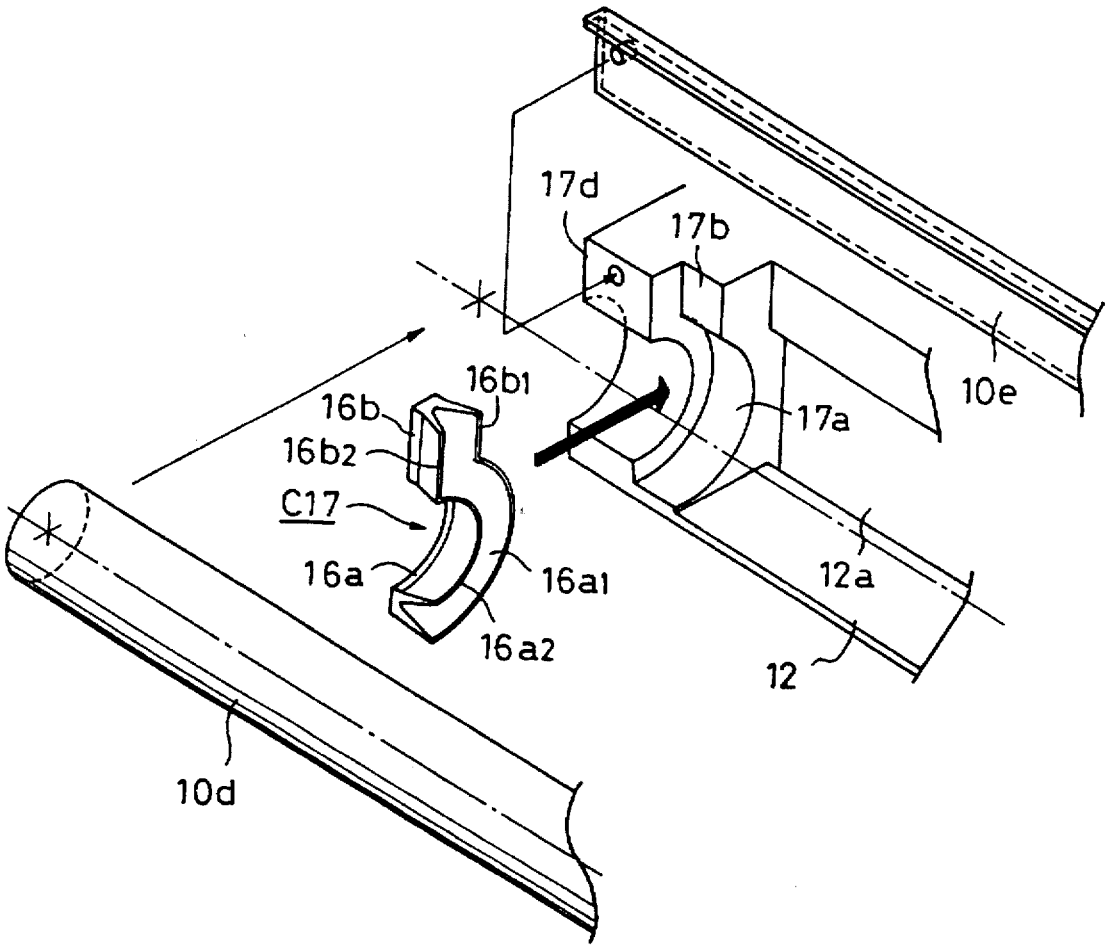
FIG. 31 is an illustration of how a sealing member of a fifteenth embodiment is attached.
Figure 32:
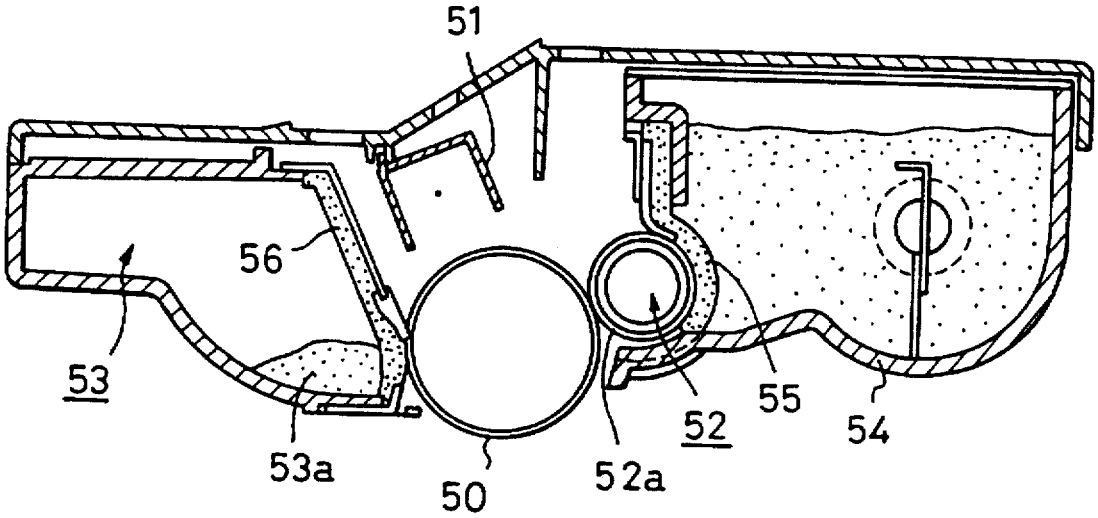
FIG. 32 PRIOR ART
FIG. 32 is an illustration of the prior art.

Although the above-described thirteenth embodiment describes an example in which the development blade 40e is mounted on the blade support member 40f and this blade support member 40f is mounted on the frame member 42, a description will now be given of a seal arrangement in which the blade is made of a rigid member integrally formed with the blade support member, with reference to FIG. 31.

The development blade 40e made of a rigid member is mounted so that there is a slight clearance between it and the surface of the development sleeve 40d. When the toner kept on the development sleeve 40d is passed through the above clearance, the toner is given an electric charge and regulated so as to have a uniform thickness on the development sleeve 40d.

Since the development blade 40e is directly fixed to the mounting surface 47d of the frame member 42 so that the development blade portion becomes flush with the blade support member portion, a sealing member C17 for sealing the space between the frame member 42 and the development blade 40e does not require the compressed seal portion 16c of the thirteenth embodiment.

More specifically, the sealing member C17 comprises a circular rotary seal portion 46a and a straight-line blade seal portion 46b, lip portions 46a1 and 46a2 and lip portions 46b1 and 46b2 being provided respectively therein. The seating surface of the frame member 42, to which surface the sealing member C17 is attached, is formed of a circular seating surface 47a for receiving the circular rotary seal portion 46a and a straight-line seating surface 47b for receiving the straight-line blade seal portion 46b.

When the sealing member C17 is attached to the blade support member of the frame member 42, the lip portion 46a1 comes into close contact with the circular seating surface 47a, and the lip portion 46a2 comes into close contact with the development sleeve 40d. Further, the lip portion 46b1 comes into close contact with the straight-line seating surface 47b, and the lip portion 46b2 comes into close contact with the development blade 40e. As a result, the gap formed among the frame member 42, the development sleeve 40*d* and the development blade 40*e* is completely covered by the sealing member C17, thus providing secure sealing properties.

[Other embodiment]

The process cartridge B of the present invention also can be applied to a cartridge in which a plurality of developing means are provided to form an image of a plurality of colors (for example, a two-color image, three-color image or full-color image).

Various development methods including a well-known two-component magnetic brush development method, cascade development method, touch-down development method, and cloud development method can be used.

Although a so-called contact charging method is used in the above-described first embodiment, an arrangement may also of course be used in which a metallic shield of aluminum or the like is coated onto the periphery of the three portions of a tungsten wire used conventionally and positive or negative ions caused by applying a high voltage to the tungsten wire are moved to the surface of the photosensitive drum, so that the surface of the drum is uniformly charged. The above charging means may be, in addition to the above-described roller type, a blade type (charging blade), pad type, block type, rod type, wire type or the like.

The blade member may be mounted on the frame member via a support member as shown in the first embodiment, or it may be directly mounted on the frame member as described in the third embodiment. The mounting of the blade member can be performed by various methods, for example, attachment using screws or a bonding agent.

The above-described process cartridge comprises an electrophotographic photosensitive member serving as an image carrier and at least one process means. More specifically, the process cartridge is, for example, one in which charging means, developing means or cleaning means, and an electrophotographic photosensitive member serving as an image carrier are formed integrally into a cartridge, and this cartridge can be loaded into and unloaded from the main body of the image forming apparatus. In another example, at least one of the charging means, developing means and cleaning means, and an electrophotographic photosensitive member are formed integrally into a cartridge, so that this cartridge can be loaded into and unloaded from the main body of the image forming apparatus. In a further example, at least the developing means and an electrophotographic photosensitive member are formed integrally into a cartridge so that it can be loaded into and unloaded from the main body of the image forming apparatus.

In the above-described embodiments an example has been described in which a sealing member is attached to prevent toner from leaking from a space formed between the development frame member and the development sleeve which constitute a process cartridge, and the development blade, or to prevent toner from leaking from a section including the cleaning frame member, the photosensitive drum and the cleaning blade. However, the sealing member can be applied, similarly to that described above, to an image forming apparatus having no process cartridge loaded therein, that is, an apparatus in which a photosensitive drum, a development sleeve and a blade are directly installed into the main body of the apparatus.

Although in the above-described embodiments a laser beam printer is shown as an image forming apparatus, the present invention is not limited to this example, it can of course be used in other image forming apparatuses such as electrophotographic copying machines, facsimile apparatuses, or word processors.

According to the present invention, as described above, since lip portions are provided in a sealing member, and these lip portions are brought into abutment with the end portions of the blade member, it is possible to securely prevent toner leakage, to prevent toner from entering the sliding portion between the sealing member and the process means, and to limit an increase in the rotational torque as a result of the fixing of the toner. In addition, it becomes possible to make easier the attachment of the sealing member to thus facilitate the attachment operation.

Since pressing lip portions are provided in the sealing member and the sealing member is brought into contact with the frame member by the elastic force of the lip portions, it is possible to increase sealing properties.

If sealing members for preventing toner from leaking from a section including the image carrier, the developing means, the cleaning means and the frame member are formed integrally, it is possible to facilitate the attachment of the sealing members.

If engagement means for engaging with the frame member is provided in the sealing member, then the sealing member is securely fixed, and thus there is no possibility that the sealing member will become detached when it has been attached to the frame member.

If a magnetic substance is provided in the sealing member to give the sealing member a magnetic force, it is possible to adsorb the toner leaking in the seal portion, making it possible to prevent toner leakage more securely.

According to the present invention, as described above, since a sealing member is formed by providing a rotary seal portion for sealing the space between a frame member and a rotary member, a blade seal portion for sealing the space between the frame member and a blade member, and a compressed seal portion, provided in the rotary seal portion and the blade seal portion, for sealing the longitudinal end portion of the blade member, it is possible to seal, in addition to the rotary member and the blade support member, the longitudinal end portion of the blade. Therefore, unlike in the prior art, there is no risk that toner will leak from the space between the two sealing members, thus providing more secure sealing properties. Further, since it is only necessary to attach the sealing member to the seating surface of the frame member, attachment properties are considerably improved.

In addition, when the blade member is formed integrally with the blade support member, it is possible to seal a section including the frame member, the blade and the rotary member more easily by using a sealing member having a rotary seal portion and a blade seal portion provided therein.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded a broad interpretation, so as to encompass all such modifications and equivalent structures and functions.

What is claimed is:

1. A process cartridge detachably mountable to an image forming apparatus, said process cartridge comprising:

a frame member having at least one recess formed therein;

a photosensitive member;

process means mounted on said frame member; and a sealing member for preventing toner from leaking from a space formed between said frame member and said process means, said sealing member comprising at least engagement means being insertable in the at least one recess for engaging said sealing member with said frame member.

2. A process cartridge according to claim 1, wherein said process means is an image carrier.

3. A process cartridge according to claim 1, wherein said process means is formed of a soft plastic material.

4. A process cartridge according to claim 1, wherein said process means is formed of a blade.

5. A process cartridge according to claim 1, wherein said process means is formed of a development sleeve.

6. A process cartridge according to claim 1, wherein said process means is a toner supply member.

7. A process cartridge according to claim 5, wherein said process means is toner supply means for supplying toner to said development sleeve.

8. A process cartridge according to claim 1, wherein said process cartridge comprising one of charging means, developing means and cleaning means as said process means, and an electrophotographic photosensitive member as an image carrier is integrally formed, and wherein said cartridge can be loaded into and unloaded from a main body of the image forming apparatus.

9. A process cartridge according to claim 1, wherein said process cartridge comprising at least one of charging means, developing means and cleaning means as said process means, and an electrophotographic photosensitive member as an image carrier is integrally formed, and wherein said cartridge can be loaded into and unloaded from a main body of the image forming apparatus.

10. A process cartridge according to claim 1, wherein said process cartridge comprising at least developing means as said process means, and an electrophotographic photosensitive member as an image carrier is integrally formed, and wherein said cartridge can be loaded into and unloaded from a main body of the image forming apparatus.

11. An image forming apparatus, to which a process cartridge is detachably mountable for forming an image on a recording medium, said image forming apparatus comprising:

cartridge mounting means for detachably mounting the process cartridge, said process cartridge comprising: a frame member having at least one recess formed therein, a photosensitive member, process means mounted on said frame member, and a sealing member for preventing toner from leaking from a space formed between said frame member and said process means, said cartridge mounting means including engagement means being insertable in the at least one recess for engaging said sealing member with said frame member;

optical means for projecting light according to image information; and feeding member for feeding a recording medium.

12. An image forming apparatus according to claim 11, wherein said image forming apparatus is an electrophotographic copying machine.

13. An image forming apparatus according to claim 11, wherein said image forming apparatus is a laser beam printer.

14. An image forming apparatus according to claim 11, wherein said image forming apparatus is a facsimile apparatus.

15. A sealing member for an image forming apparatus including a frame member, a rotary member and a blade member, said sealing member comprising:

a rotary seal portion for sealing a space formed between a frame member and a rotary member;

a blade seal portion for sealing a space formed between said frame member and a blade member; and a compressable seal portion, provided in a portion of said rotary seal portion and said blade seal portion, for sealing a space formed adjacent a longitudinal end portion of said blade member.

16. A sealing member according to claim 15, wherein said rotary seal portion and said blade seal portion are formed of a soft plastic material, and said compressable seal portion is formed of a compressable elastic member.

17. A sealing member according to claim 15, wherein said sealing member prevents toner from leaking from a space formed between said frame member, said rotary member and said blade member.

18. A process cartridge detachably mountable to an image forming apparatus, said process cartridge comprising:

a frame member;

a rotary member mounted on said frame member, said rotary member constituting process means;

a blade member elastically contacting said rotary member; and a sealing member having a rotary seal portion for sealing a space formed between the frame member and the rotary member; a blade seal portion for sealing a space formed between the frame member and the blade member; and a compressable seal portion, provided in a portion of said rotary seal portion and said blade seal portion, for sealing a space formed adjacent a longitudinal end portion of said blade member.

19. A process cartridge detachably mountable to an image forming apparatus, said process cartridge comprising:

a frame member;

a photosensitive member;

a rotary member mounted on said frame member, said rotary member constituting process means;

a blade member mounted on said frame member and in proximity with said rotary member; and a sealing member having a rotary seal portion for sealing a space formed between said frame member and said rotary member; a blade seal portion for sealing a space formed between said frame member and said blade member; and a compressible seal portion, provided in a portion of said rotary seal portion and said blade seal portion, for sealing a space formed adjacent a longitudinal end portion of said blade member.

20. A process cartridge according to claim 18, wherein said rotary member is an image carrier for forming a toner image, and said blade member is a cleaning blade for removing toner remaining on said image carrier.

21. A process cartridge according to one of claims 18 and 19, wherein said rotary member is a development sleeve, and said blade member is a development blade for regulating a thickness of a layer of toner applied to said development sleeve.

22. A process cartridge according to claim 18, wherein said process cartridge comprising one of charging means, developing means and cleaning means as said process means, and an electrophotographic photosensitive member as an image carrier is integrally formed, and wherein said cartridge can be loaded into and unloaded from a main body of the image forming apparatus.

23. A process cartridge according to claim 18, wherein said process cartridge comprising at least one of charging means, developing means and cleaning means as said process means, and an electrophotographic photosensitive member as an image carrier is integrally formed, and wherein said cartridge can be loaded into and unloaded from a main body of the image forming apparatus.

24. A process cartridge according to claim 18, wherein said process cartridge comprising at least one of developing means as said process means, and an electrophotographic photosensitive member as an image carrier is integrally formed, and wherein said cartridge can be loaded into and unloaded from a main body of the image forming apparatus.

25. An image forming apparatus, to which a process cartridge is detachably mountable, for forming an image on a recording medium, said image forming apparatus comprising:

optical means for projecting light according to image information;

feeding means for feeding a recording medium; and cartridge mounting means comprising a frame member, a rotary member mounted on said frame member, said rotary member constituting process means, a blade member elastically contacting said rotary member, and a sealing member having a rotary seal portion for sealing a space formed between the frame member and the rotary member; a blade seal portion for sealing a space formed between the frame member and the blade member; and a compressable seal portion, provided in a portion of said rotary seal portion and said blade seal portion, for sealing a space formed adjacent a longitudinal end portion of the blade member.

26. An image forming apparatus, to which a process cartridge is detachably mountable, for forming an image on a recording medium, said image forming apparatus comprising:

optical means for projecting light according to image information;

feeding means for feeding a recording medium; and cartridge loading means for detachably loading the process cartridge, said process cartridge comprising a frame member, a photosensitive member, a rotary member mounted on said frame member, said rotary member constituting process means, a blade member mounted on said frame member and in proximity with said rotary member, and a sealing member having a rotary seal portion for sealing a space formed between the frame member and the rotary member, a blade seal portion for sealing a space formed between the frame member and the blade member; and a compressible seal portion, provided in a portion of said rotary seal portion and said blade seal portion, for sealing a space formed adjacent a longitudinal end portion of said blade member.

27. An image forming apparatus according to one of claims 25 and 26, wherein said image forming apparatus is an electrophotographic copying machine.

28. An image forming apparatus according to one of claims 25 and 26, wherein said image forming apparatus is a laser beam printer.

29. An image forming apparatus according to one of claims 25 and 26, wherein said image forming apparatus is a facsimile apparatus.

* * * * *

UNITED STATES PATENT AND TRADEMARK OFFICE

CERTIFICATE OF CORRECTION

PATENT NO. : 5,697,021

DATED : December 9, 1997

INVENTOR(S) : Watanabe et al.

It is certified that error appears in the above-identified patent and that said Letters Patent is hereby corrected as shown below:

On the title page, Item [30]:

At Foreign Application Priority Data

"Apr. 7, 1993 Japan ..... 5-114162" should read --Apr. 19, 1993 Japan .....5-114162--.

Column 1

Line 57, "varies," should read --vary,--.

Column 6

Line 19, "has been drive" should read --has been transferred by the image forming section passes between the drive--.

Column 13

Line 37, "material," should read --material--.

Column 15

Line 25, "is" should read --are--.

UNITED STATES PATENT AND TRADEMARK OFFICE

CERTIFICATE OF CORRECTION

PATENT NO. : 5,697,021

DATED : December 9, 1997

INVENTOR(S) : Watanabe et al.

It is certified that error appears in the above-identified patent and that said Letters Patent is hereby corrected as shown below:

Column 16

Line 8, "come" should read --comes--.

Signed and Sealed this

Eighth Day of September, 1998

*Attest:*

*Attesting Officer*

Bruce Lehman

BRUCE LEHMAN

*Commissioner of Patents and Trademarks*